US011158441B1

(12) United States Patent
Farkas et al.

(10) Patent No.: US 11,158,441 B1
(45) Date of Patent: Oct. 26, 2021

(54) HIGH-SPEED CABLE DRAIN WIRE SYSTEM

(71) Applicant: Dell Products L.P., Round Rock, TX (US)

(72) Inventors: Sandor Farkas, Round Rock, TX (US); Bhyrav Mutnury, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 17/143,894

(22) Filed: Jan. 7, 2021

(51) Int. Cl.

| | |
|---|---|
| ***H01B 11/16*** | (2006.01) |
| ***H01B 11/10*** | (2006.01) |
| ***H01R 13/56*** | (2006.01) |
| ***H01R 13/6591*** | (2011.01) |

(52) U.S. Cl.
CPC ..... *H01B 11/1091* (2013.01); *H01B 11/16* (2013.01); *H01R 13/56* (2013.01); *H01R 13/65915* (2020.08)

(58) Field of Classification Search
CPC ... H01B 5/12; H01B 7/04; H01B 7/08; H01B 7/0807; H01B 7/0823; H01B 7/0838; H01B 7/2825; H01B 9/02; H01B 31/06; H01B 11/002; H01B 11/02; G06F 13/12; G06F 13/42
USPC ..... 174/110 R, 113 C, 113 R, 117 R, 117 F, 174/117 FF, 120 R; 427/117
See application file for complete search history.

(56) References Cited

U.S. PATENT DOCUMENTS

| | | | | |
|---|---|---|---|---|
| 7,271,340 | B2 * | 9/2007 | Buck | H01B 7/0892 174/75 C |
| 9,589,704 | B2 * | 3/2017 | Gareis | D04C 1/06 |
| 9,961,813 | B2 * | 5/2018 | Kobayashi | H01B 11/002 |
| 10,573,434 | B2 * | 2/2020 | Kobayashi | H01B 7/0869 |
| 10,585,816 | B1 * | 3/2020 | Lambert | G06F 1/3215 |
| 2003/0168242 | A1 * | 9/2003 | Whidden | H01B 9/029 174/113 R |
| 2011/0083877 | A1 * | 4/2011 | Sugiyama | H01P 11/001 174/115 |

FOREIGN PATENT DOCUMENTS

| | | | | |
|---|---|---|---|---|
| CN | 205451814 | * | 8/2016 | H01B 5/12 |

* cited by examiner

*Primary Examiner* — William H. Mayo, III
(74) *Attorney, Agent, or Firm* — Joseph Mencher

(57) ABSTRACT

A high-speed cable drain wire system includes a cable shield housing conductor(s), an insulator subsystem that surrounds the conductor(s), and drain wire subsystem(s) that each have at least one drain wire strand, and with each drain wire strand including a plurality of drain wires. The plurality of drain wires in each drain wire strand may be positioned in a side-by-side orientation or a twisted orientation, and when the at least one drain wire strand included a the plurality of drain wire strands, the plurality of drain wire strands in each drain wire subsystem may be positioned in a braided orientation or a twisted orientation. In response to routing the cable, a bend may be produced in the drain wire subsystem (s), and the plurality of drain wires in each drain wire strand are configured to experience a stress that is less than a stress threshold in response to the bend.

20 Claims, 20 Drawing Sheets

HIGH-SPEED CABLE DRAIN WIRE SYSTEM

BACKGROUND

The present disclosure relates generally to information handling systems, and more particularly to drain wires in cables that are used to connect information handling systems and their components.

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems such as, for example, server devices, networking devices, storage devices, and/or other computing devices known in the art, utilize cables to connect to each other, as well as to connect their components, and/or to connect a variety of other computing subsystems known in the art. For example, dual-axial cables are often utilized for the transmission of highspeed Serializer/Deserializer (serdes) signal transmissions, and typically include a pair of conducting wires that are each surrounded by an insulator, one or more drain wires, and a conductive cable shield that is wrapped around the conducting wires and drain wire(s). As the speed at which signals are transmitted increases, the signal integrity sensitivity of those signals to parasitic effects increases as well, and subtle effects that that do not impact signal performance at lower signals transmission speeds will begin to effect signal performance at higher signals transmission speeds.

For example, it has been found that the drain wire(s) in cables can produce signal attenuation issues with relatively high-speed signals when those drain wires have been repeated bent, flexed, and/or otherwise stressed. As discussed in further detail below, drain wire(s) provide a path for a return current from the conductors in the cable, and the cable may be repeatedly bent, flexed, and/or otherwise stressed in order to route that cable through the computing device chassis and/or between computing devices. For example, cables often have relatively sharp bends near their connectors and/or near locations on the cable that connect to a device connector in a computing device, and the cable may also be bent, flexed, and/or otherwise stressed in order to route it along a desired path and/or through relatively small openings (e.g., flexible flat cable systems including a plurality of the cables discussed above are often bent, folded, and/or rolled in order to fit them through relatively small openings). As discussed below, it has been found that the repeated bending, flexing, and/or otherwise stressing of cables may produce performance issues with the drain wire(s) in those cables due to repetitive mechanical stresses on the drain wire(s) (e.g., tensile and compressive stresses across the thickness of the drain wire) that can cause the drain wire(s) to fatigue and crack, which may compromise signal integrity characteristics of the cable and produce signal attenuation and/or signal losses. Conventional solutions to such issues include attempting to minimize the bend radius of the cable using mechanical stiffeners, which limits the ability to route the cable, and has found to be insufficient to prevent the issues discussed above.

Accordingly, it would be desirable to provide a high-speed cable drain wire system that addresses the issues discussed above.

SUMMARY

According to one embodiment, an Information Handling System (IHS) includes a processing system; a memory system that is coupled to the processing system and that includes instructions that, when executed by the processing system, cause the processing system to provide a signal transmission engine; and a cable that is coupled to the processing system, wherein the cable includes: a cable shield; a first conductor that is housed in the cable shield and that is configured to transmit signals received from the signal transmission engine; an insulator subsystem that surrounds the first conductor and that is housed in the cable shield; and a first drain wire subsystem that is housed in the cable shield and that is configured to conduct a first return current that is generated in response to the first conductor transmitting the signals, wherein the first drain wire subsystem includes at least one first drain wire strand, and wherein each first drain wire strand includes a plurality of first drain wires.

DETAILED DESCRIPTION

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components.

Figure 1:
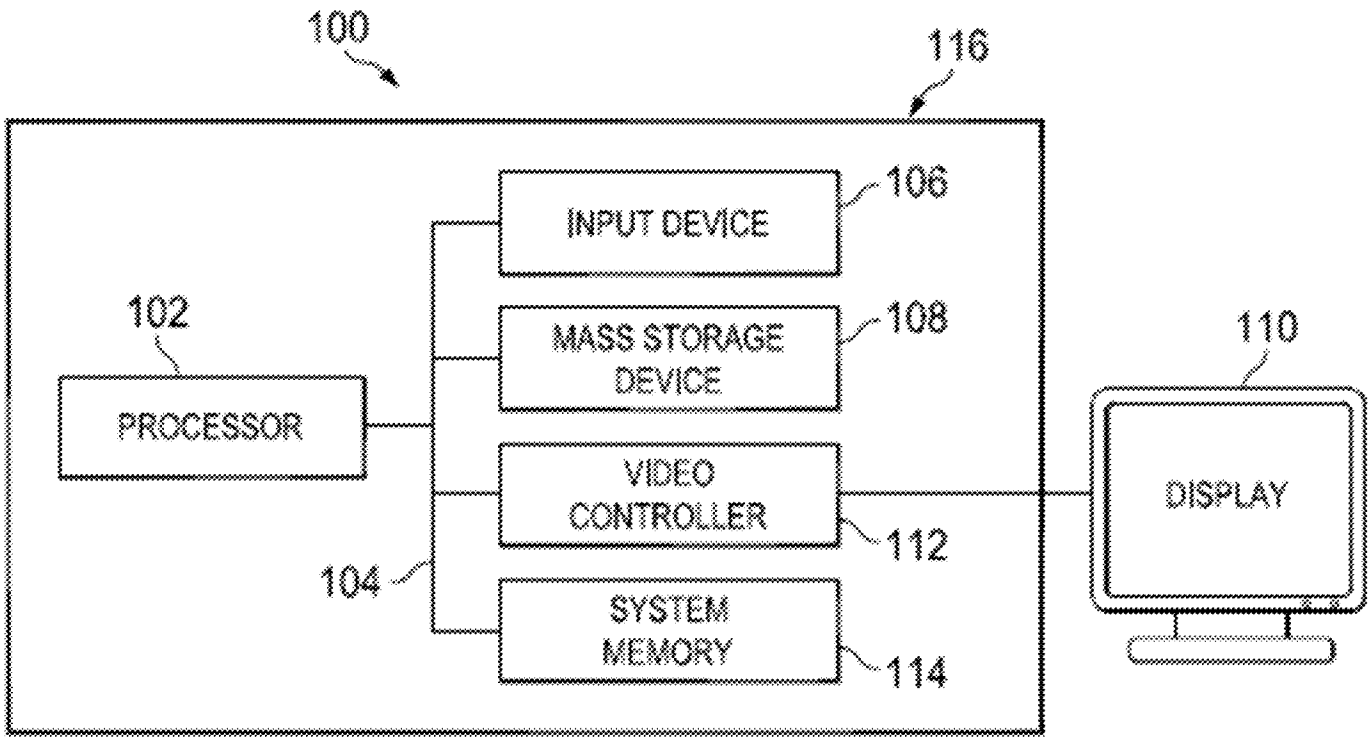
FIG. 1 is a schematic view illustrating an embodiment of an Information Handling System (IHS).

In one embodiment, IHS 100, FIG. 1, includes a processor 102, which is connected to a bus 104. Bus 104 serves as a connection between processor 102 and other components of IHS 100. An input device 106 is coupled to processor 102 to provide input to processor 102. Examples of input devices may include keyboards, touchscreens, pointing devices such as mouses, trackballs, and trackpads, and/or a variety of other input devices known in the art. Programs and data are stored on a mass storage device 108, which is coupled to processor 102. Examples of mass storage devices may include hard discs, optical disks, magneto-optical discs, solid-state storage devices, and/or a variety of other mass storage devices known in the art. IHS 100 further includes a display 110, which is coupled to processor 102 by a video controller 112. A system memory 114 is coupled to processor 102 to provide the processor with fast storage to facilitate execution of computer programs by processor 102. Examples of system memory may include random access memory (RAM) devices such as dynamic RAM (DRAM), synchronous DRAM (SDRAM), solid state memory devices, and/or a variety of other memory devices known in the art. In an embodiment, a chassis 116 houses some or all of the components of IHS 100. It should be understood that other buses and intermediate circuits can be deployed between the components described above and processor 102 to facilitate interconnection between the components and the processor 102.

Figure 2A:
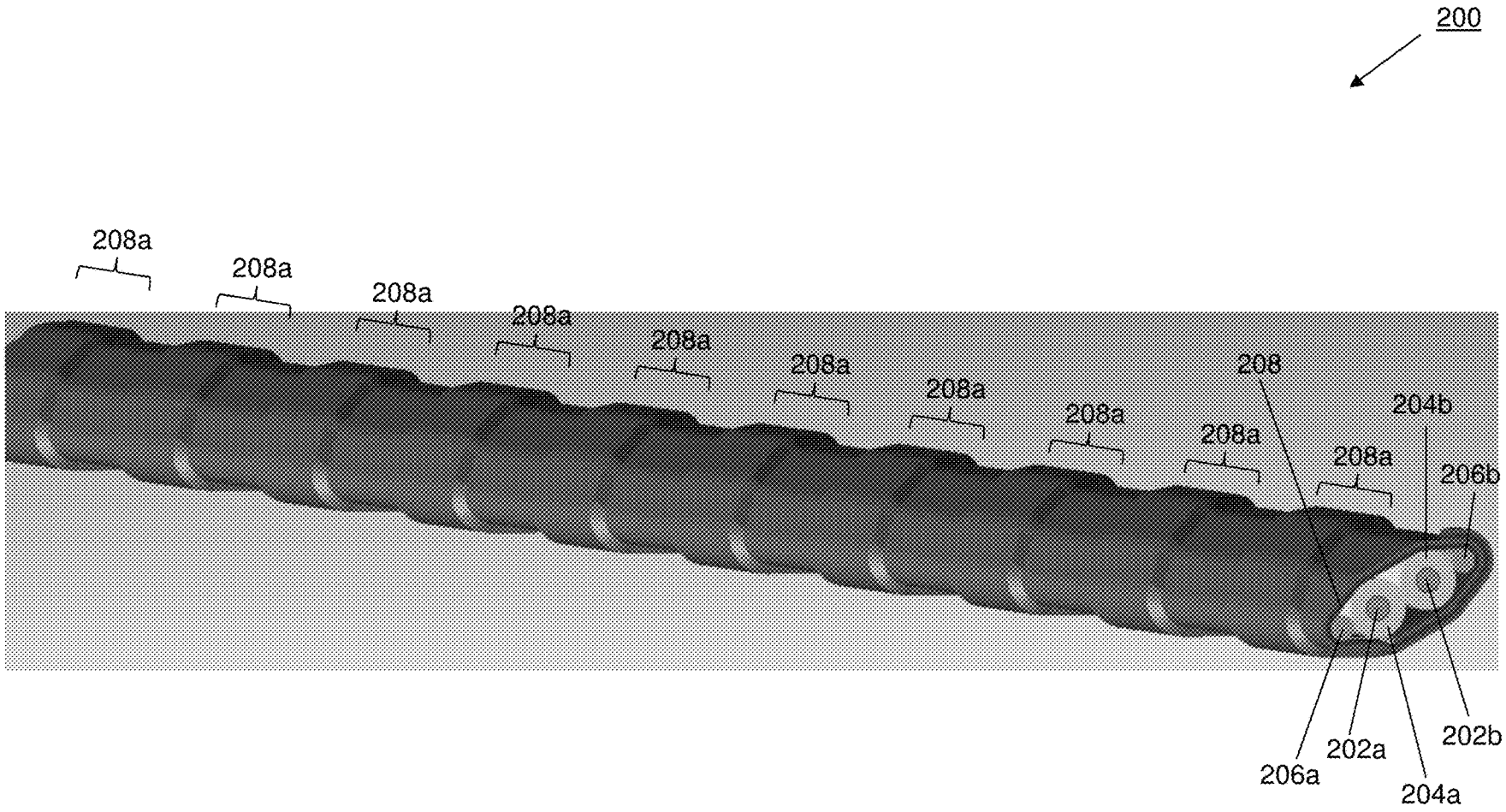
FIG. 2A is a perspective cut-away view illustrating an embodiment of a cable.
Figure 2B:
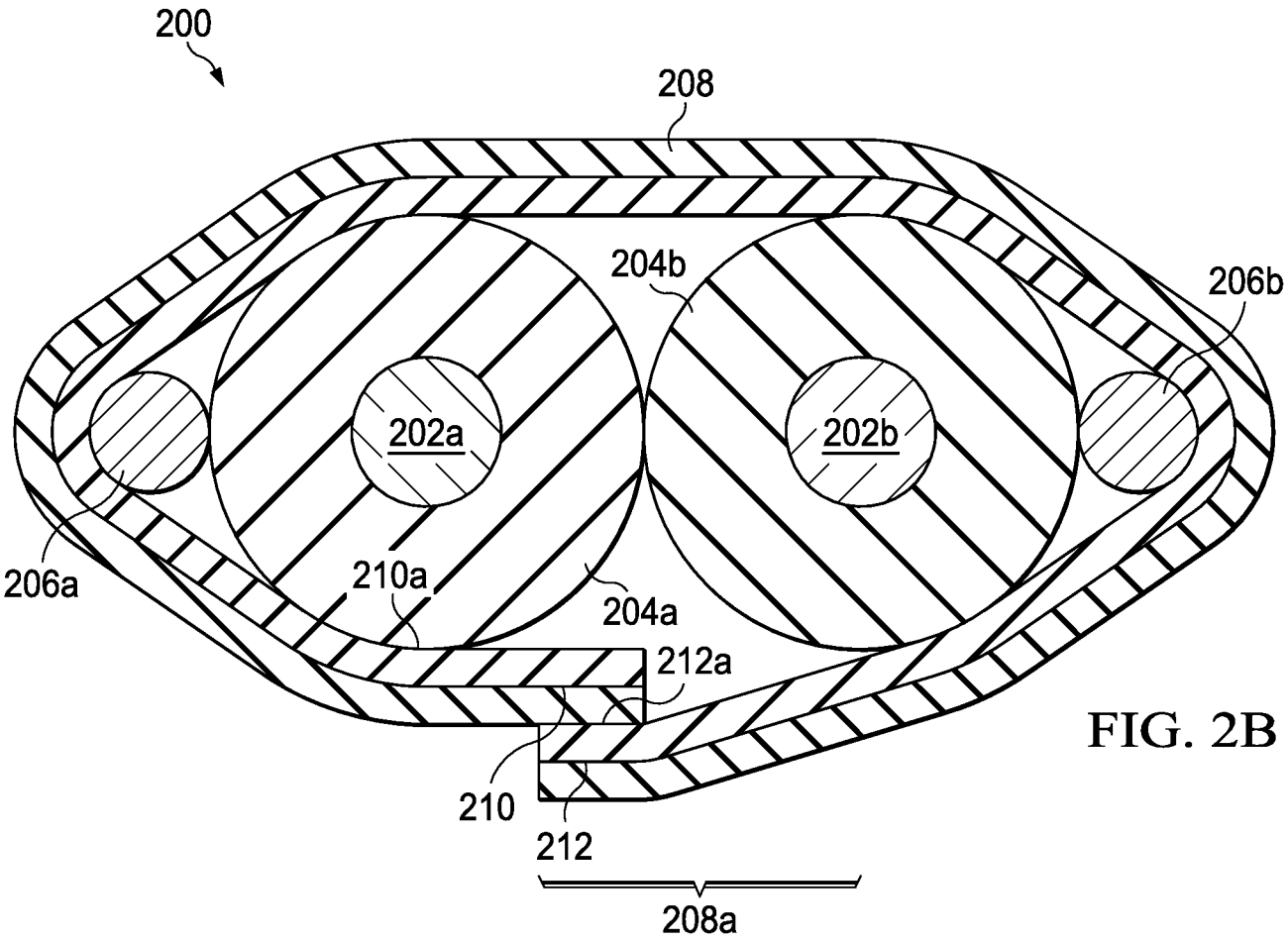
FIG. 2B is a cross-sectional view illustrating an embodiment of the cable of FIG. 2A.

Referring now to FIGS. 2A and 2B, an embodiment of a cable 200 is illustrated that may utilize the high-speed cable drain wire system of the present disclosure is illustrated. However, in the discussions below, the cable 200 is also used to describe a conventional cable drain wire system as well, and thus one of skill in the art in possession of the present disclosure will appreciate that some embodiments of the cable 200 illustrated in FIGS. 2A and 2B may include conventional drain wires while other embodiments of the cable 200 illustrated in FIGS. 2A and 2B may include the drain wire subsystems of the present disclosure. The cable 200 includes at least one cable component that, in the examples illustrated and discussed below, is provided by a pair of conductors 202*a* and 202*b* that may include a variety of conductive wiring that would be apparent to one of skill in the art in possession of the present disclosure, and an insulator subsystem that that includes insulators 204*a* and 204*b* that surround the conductors 202*a* and 202*b*, respectively. However, while the insulator subsystem is illustrated and discussed as including a respective insulator 204*a* and 204*b* surrounding each conductor 202*a* and 202*b*, one of skill in the art in possession of the present disclosure will appreciate that a single insulator may surround both conductors while remaining within the scope of the present disclosure as well. Furthermore, while a pair of conductors are illustrated and described, one of skill in the art in possession of the present disclosure will appreciate that cables with a single conductor may benefit from the teachings of the present disclosure as thus may fall within its scope as well.

In some of the examples discussed below that are provided to illustrated the benefits of the present disclosure, the cable component(s) may include a pair of conventional drain wires 206*a* and 206*b* that may include a variety of conductive wiring (e.g., the solid conductive copper material discussed below) that would be apparent to one of skill in the art in possession of the present disclosure. However, in embodiments of the present disclosure discussed in further detail below, the at least one cable component may include a pair of drain wire subsystems 206*a* and 206*b* that are provided according to the teachings of the present disclosure to provide the benefits described below. However, rather than a pair of drain wire subsystems provided according to the teachings of the present disclosure, a single drain wire subsystem provided according to the teachings of the present disclosure will fall within the scope of the present disclosure as well (and one of skill in the art in possession of the present disclosure will recognize that conventional cables may include a single drain wire and may be improved by replacing that single drain wire with a single drain wire subsystem provided according to the teachings of the present disclosure). As such, while specific cable components are illustrated and described below, one of skill in the art in possession of the present disclosure will appreciate that cables may include a variety of cable components and/or cable component configurations while remaining within with the scope of the present disclosure.

The cable 200 also includes a cable shield 208 that surrounds/houses the cable components, is electrically coupled to the drain wire subsystems 206*a* and 206*b* provided according to the teachings of the present disclosure (or to conventional drain wires 206*a* and 206*b* in a conventional cable), and that may be provided by a variety of conductive cable shielding materials that would be apparent to one of skill in the art in possession of the present disclosure. In the embodiments illustrated in FIGS. 2A and 2B and discussed below, the cable shield 208 is spirally wrapped around the cable components in a manner that provides a plurality of overlapping cable shield portions 208*a* that each include a first portion 210 of the cable shield 208 that also includes a surface 210*a* that may engage at least one of the cable components, and a second portion 212 of the cable shield 208 having a surface 212*a* that engages the first portion of the cable shield 208. For example, the inventors of the present disclosure describe an aperiodically overlapping spiral-wrapped cable shield system that may be utilized to provide the cable shield 208 in U.S. patent application Ser. No. 17/123,698, filed on Dec. 16, 2020, the disclosure of which is incorporated by reference herein in its entirety. However, while a specific cable 200 having a spirally-wrapped cable shield is illustrated and described below, one of skill in the art in possession of the present disclosure will recognize that cables utilizing the high-speed cable drain wire system of the present disclosure may include other cable shield configurations (e.g., uniform cable shields, conventional spiral-wrapped cable shields, etc.), and/or other components and component configurations, while remaining within the scope of the present disclosure as well.

Figure 3A:
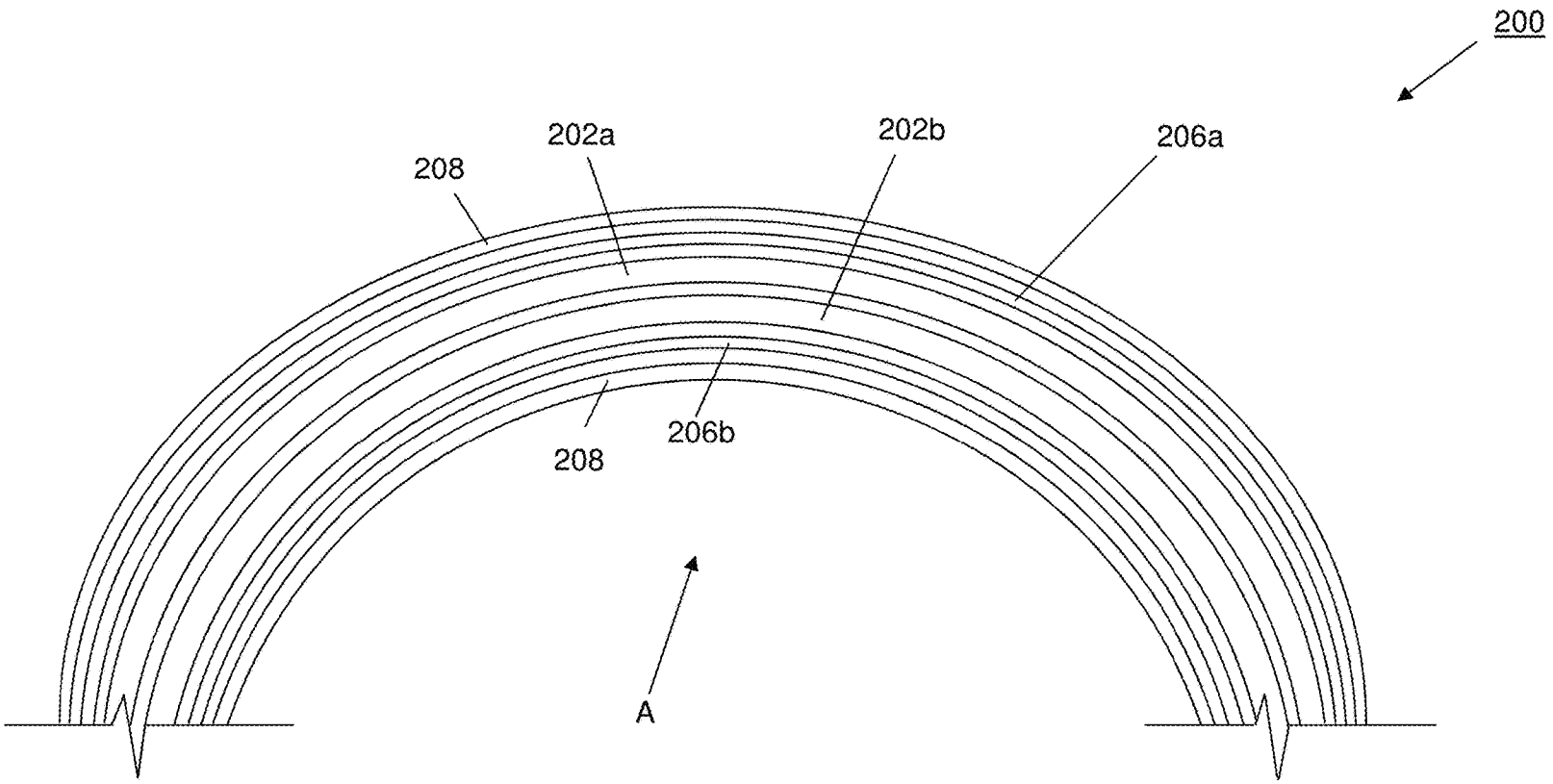
FIG. 3A is a schematic, cross-sectional view illustrating an embodiment of the cable of FIGS. 2A and 2B being bent, flexed, and/or otherwise stressed.
Figure 3B:
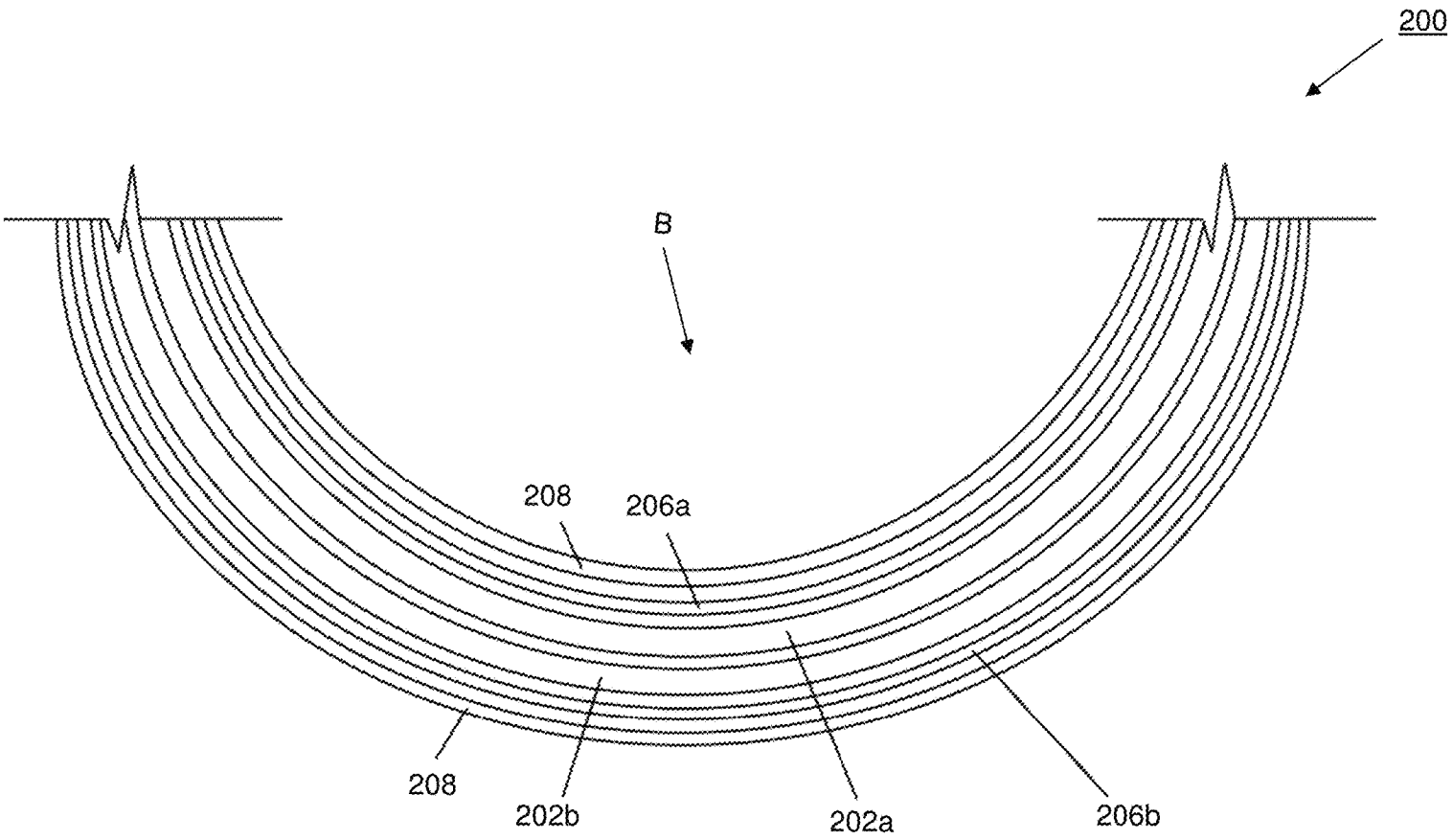
FIG. 3B is a schematic, cross-sectional view illustrating an embodiment of the cable of FIGS. 2A and 2B being bent, flexed, and/or otherwise stressed.
Figure 3C:
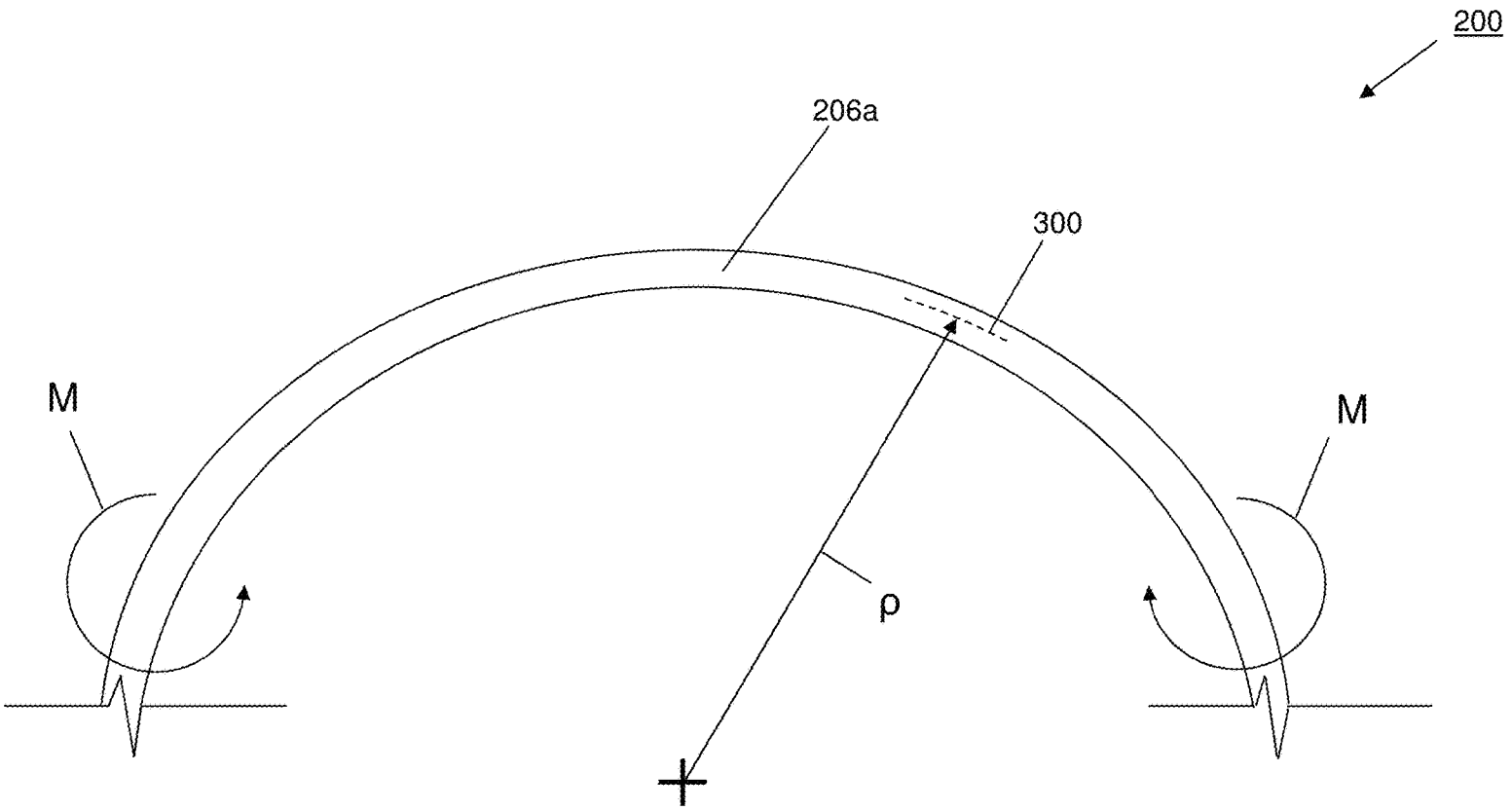
FIG. 3C is a schematic view illustrating an embodiment of a drain wire in the cable of FIGS. 2A and 2B being bent, flexed, and/or otherwise stressed.

With reference to FIGS. 3A, 3B, 3C, and 3D, and an embodiment of the operation of the cable 200 provided with conventional components and, in particular, the results of repeated bending, flexing, and/or otherwise stressing of that cable 200 and its conventional drain wires, is illustrated. As illustrated in FIGS. 3A and 3B, any portion of the cable 200 may be repeated bent, flexed, and/or otherwise stressed between an orientation A (illustrated in FIG. 3A) and an orientation B (illustrated in FIG. 3B) when, for example, the cable 200 is routed through a computing device, routed between computing devices, connected to a connector, stored, subject to forces via movement of the computing device(s) to which it is connected, and/or otherwise utilized in a manner that one of skill in the art in possession of the present disclosure would recognize causes repeated bending, flexing, and/or otherwise stressing of any particular portion of a cable. FIG. 3C illustrates the conventional drain wire 206*a* in the cable 200, which one of skill in the art in possession of the present disclosure will appreciate may be provided by a solid conducting material (e.g., copper). As illustrated in FIG. 3C, an applied moment M may produce the bending of the drain wire 206*a* in order to provide the drain wire 206*a* with a radius of curvature p (as measured between a center of curvature to a centroidal axis 300 of the drain wire 208*a*), and the stress a experienced by any portion of the drain wire 206*a* may be calculated by the bending stress equation reproduced below:

$$\sigma = E(y/\rho)$$

As will be appreciated by one of skill in the art in possession of the present disclosure, "y" in the bending stress equation above is the perpendicular distance from the centroidal axis 300 of the drain wire 208*a* to the point of interest within the drain wire 208*a* (i.e., where the stress a is being calculated), and "E" in the bending stress equation above is the modulus of elasticity of the drain wire 208*a*

Figure 3D:
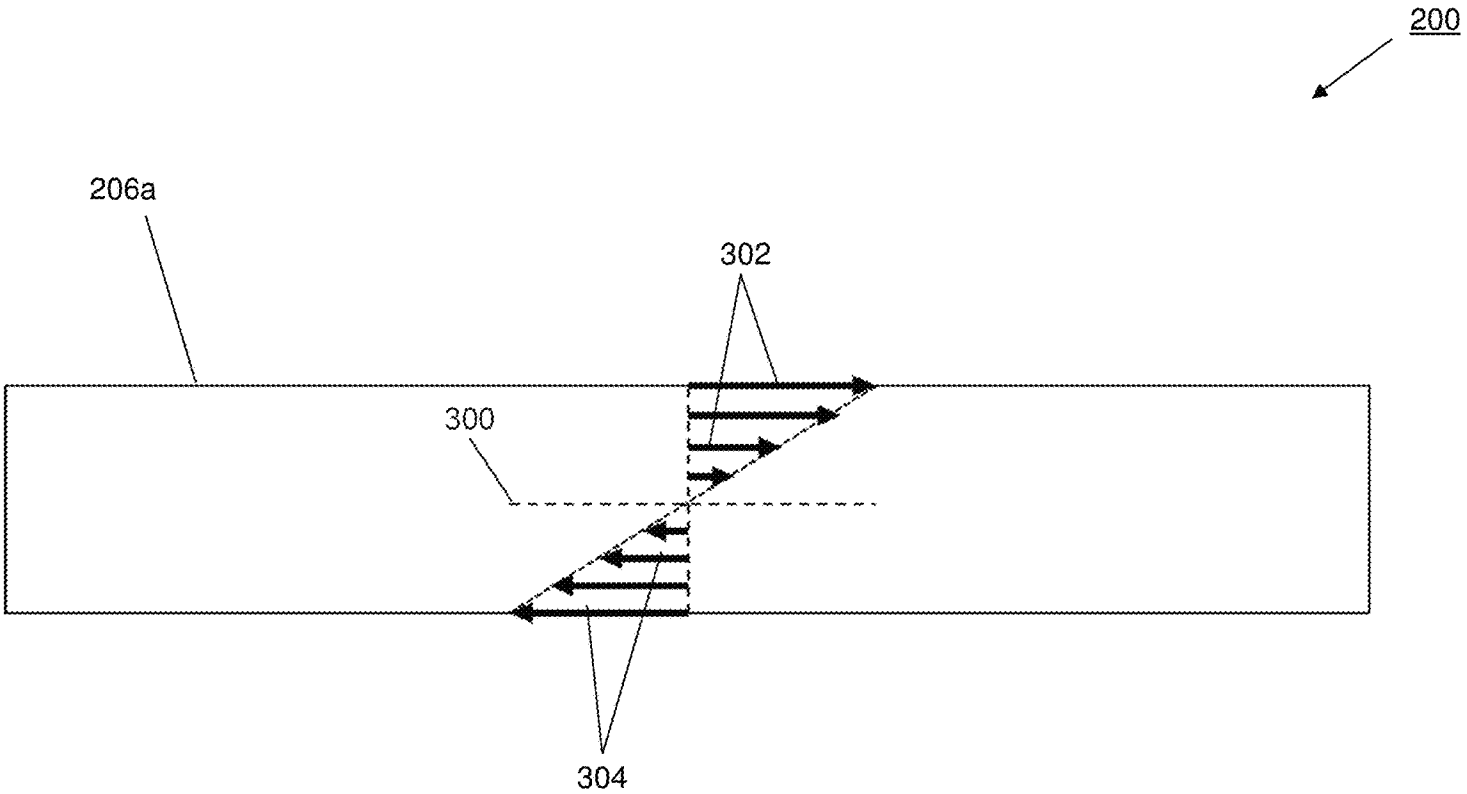
FIG. 3D is a schematic view illustrating an embodiment of a drain wire in the cable of FIGS. 2A and 2B when bent, flexed, and/or otherwise stressed.
Figure 3E:
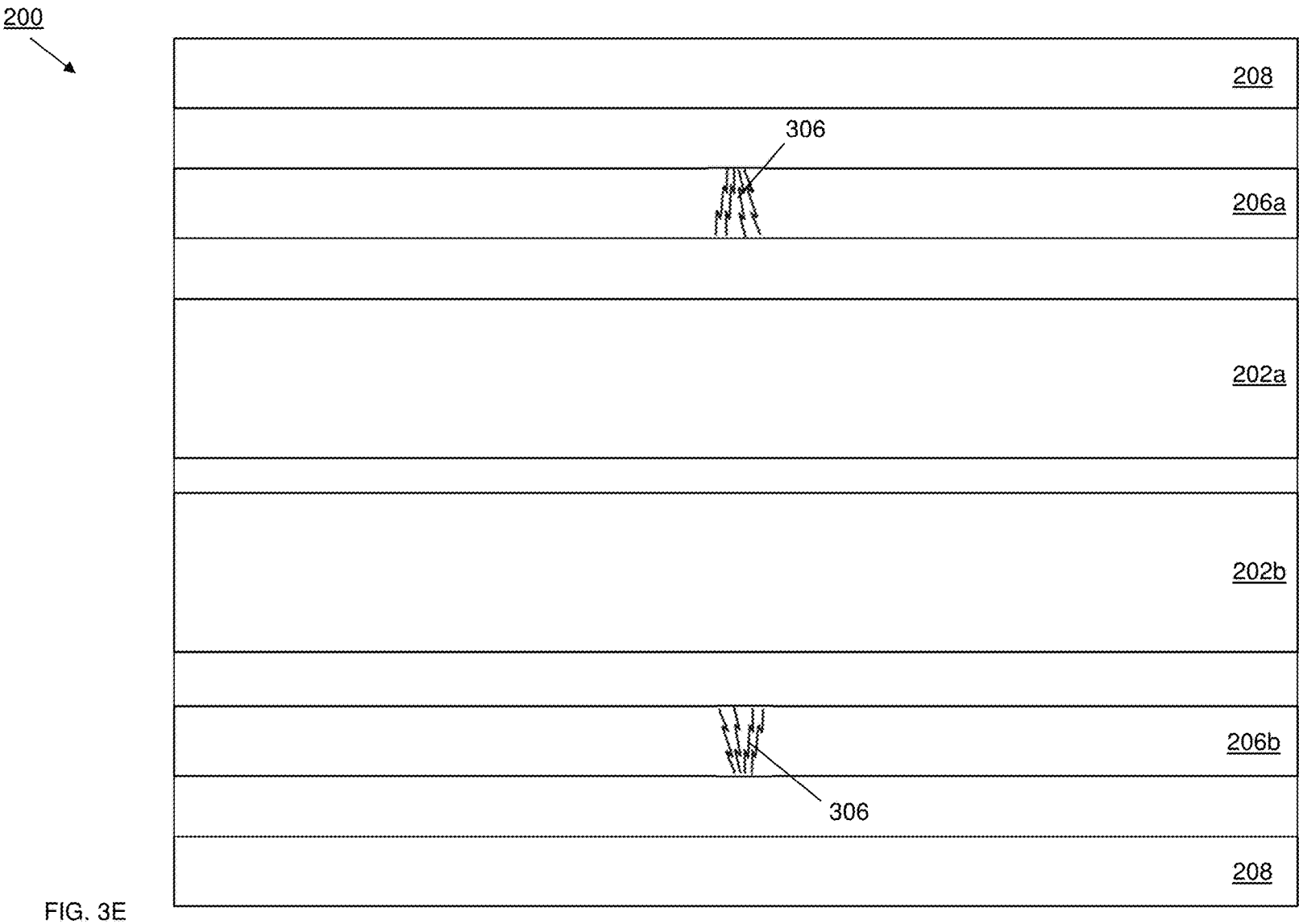
FIG. 3E (PRIOR ART)
FIG. 3E is a schematic, cross-sectional view illustrating an embodiment of the results of the cable of FIGS. 2A and 2B having been bent, flexed, and/or otherwise stressed.

As illustrated in FIG. 3D, the stresses a produced in the drain wire 206*a* are compressive in the portions of the drain wire 206*a* that are closer to the center of curvature of the drain wire 206*a*, and tensile in the portions of the drain wire 206*a* that are further from the center of curvature of the drain wire 206*a* (with the transition from compressive to tensile stress occurring at the centroidal axis 300 in the illustrated example). Furthermore, the repeated bending, flexing, and/or otherwise stressing of the cable 200 illustrated in FIGS. 3A and 3B (and thus the drain wire 206*a* illustrated in FIGS. 3C and 3D) provide for transitions between the compressive and tensile stress as the drain wire 206*a* is bent in different orientations that repeatedly transition the center of curvature of the drain wire 206*a* to opposite sides of the drain wire. It has been found that the repeated bending, flexing, and/or otherwise stressing of the conventional drain wires 206*a* and 206*b* in the cable 200 that are provided by a solid conducting material (e.g., copper) causes the cracking 306 illustrated in FIG. 3E, as well as a variety of other fatigue results that would be apparent to one of skill in the art in possession of the present disclosure. Furthermore, the cracking 306 of the drain wires 206*a* and 206*b* reduce their ability to conduct return currents, and when high frequency signals are transmitted using the cable 200, the corresponding return current will then need to find a path around the cracking in the drain wires 206*a* and 206*b*, thus changing the impedance and insertion losses in the cable 200.

Figure 4:
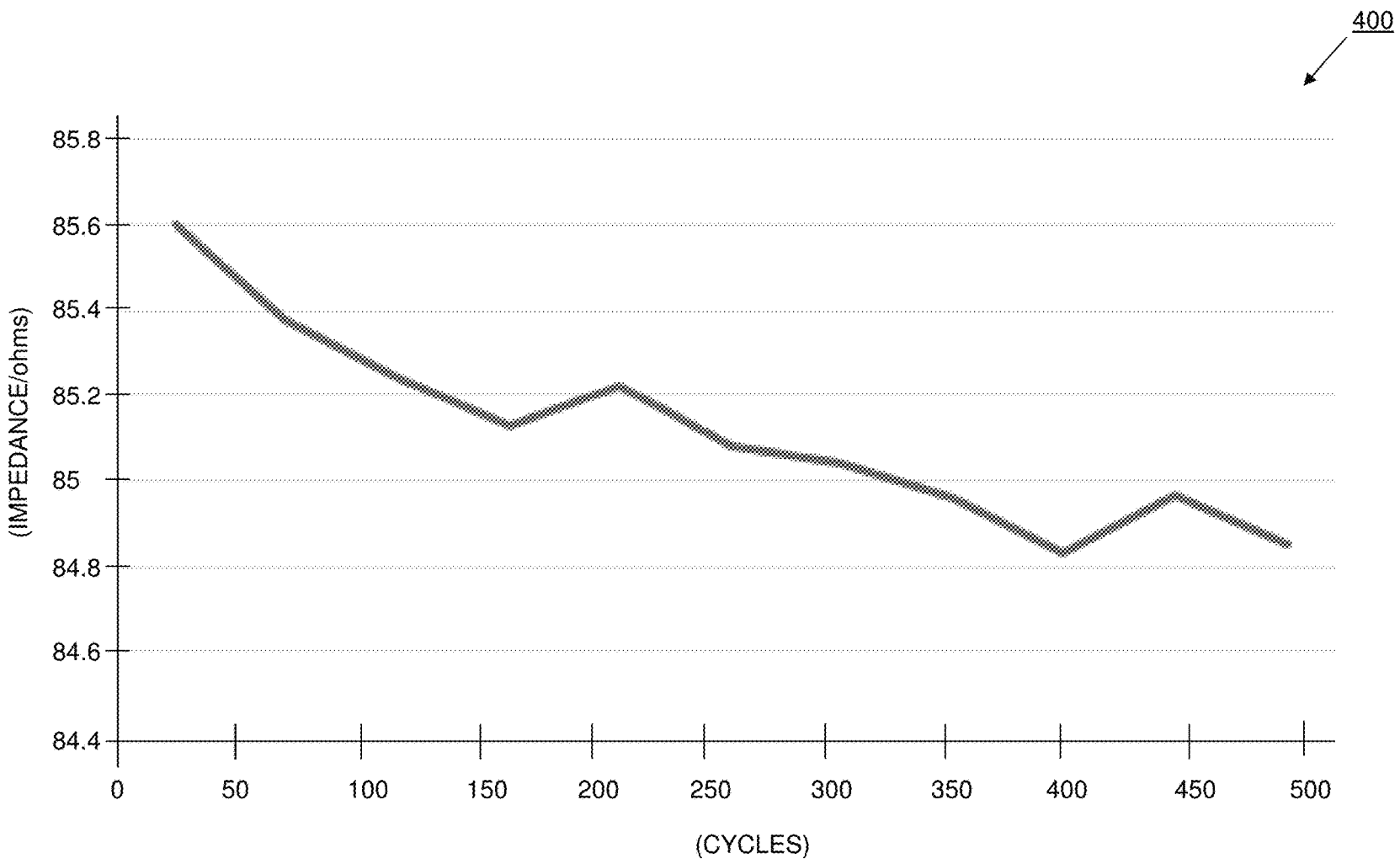
FIG. 4 (PRIOR ART)
FIG. 4 is a graph view illustrating an embodiment of impedance produced during the operation of the cable of FIGS. 2A and 2B when it includes conventional drain wire(s).

With reference to FIG. 4, an embodiment of an impedance graph 400 is illustrated that may be produced by the cable 200 discussed above with reference to FIGS. 2A, 2B, and 3A-3D over the life of the cable 200 when that cable 200 is repeatedly bent, flexed, and/or otherwise stressed. As will be appreciated by one of skill in the art in possession of the present disclosure, the impedance graph 400 illustrates the impedance provided by the cable 200 when a signal is transmitted using the cable components in that cable 200 such that a corresponding current returns via the conventional drain wires 206*a* and 206*b* provided on that cable 200, with that impedance measured following different numbers of bending cycles (e.g., bending the cable such that it cycles between the orientations of the cable 200 illustrated in FIGS. 3A and 3B). As can be seen in the specific example of the impedance graph 400 illustrated in FIG. 4, the impedance of the cable 200 reduced (from ~85.6 ohms to ~84.825 ohms) as the cable 200 experienced more bending cycles (from 0 to 500 bending cycles). However, one of skill in the art in possession of the present disclosure will appreciate that the impedance graph 400 illustrated in FIG. 4 is only an example, and that cables may experience increases in impedance as bending cycles are increased.

Figure 5:
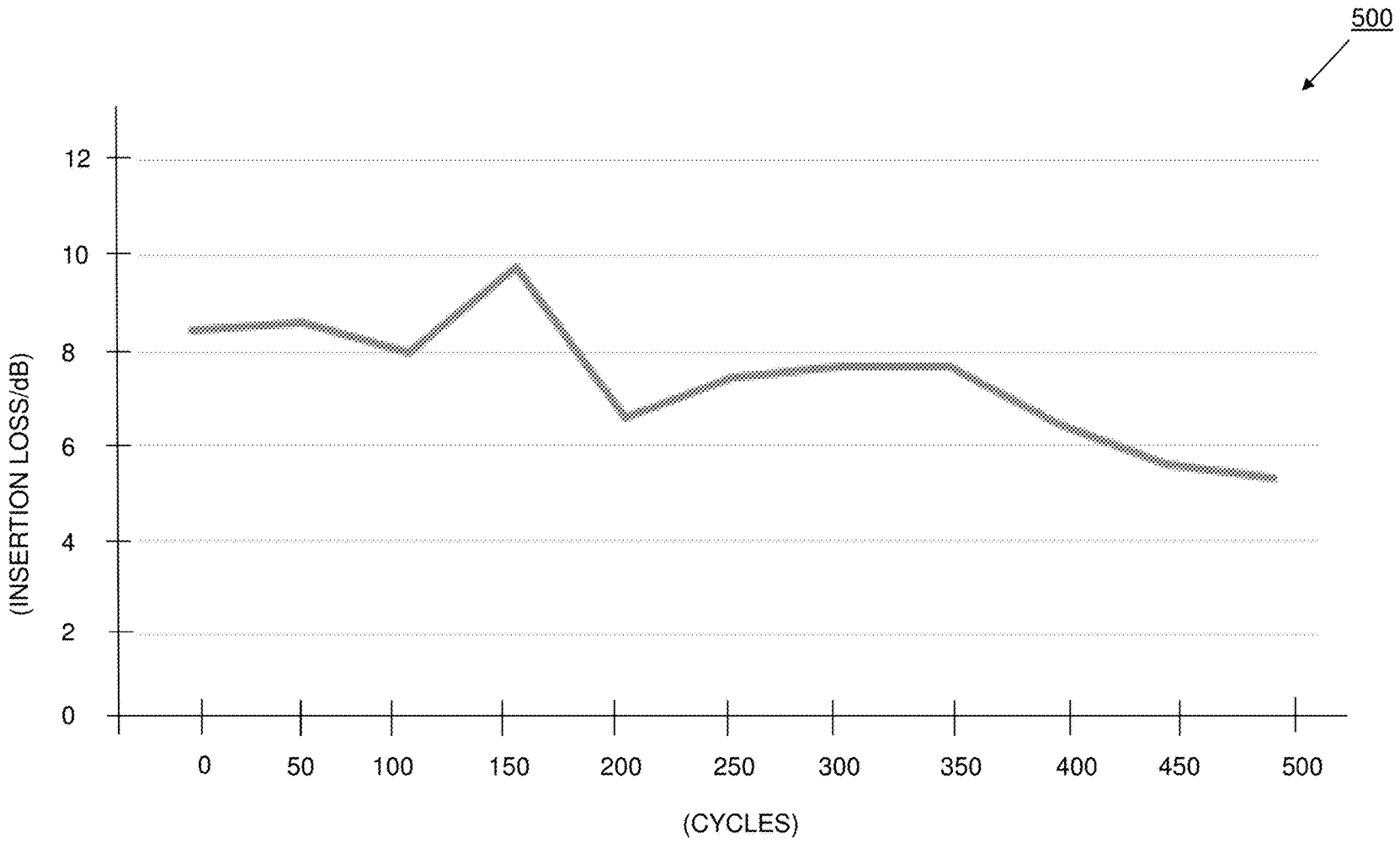
FIG. 5 (PRIOR ART)
FIG. 5 is a graph view illustrating an embodiment of insertion losses produced during the operation of the cable of FIGS. 2A and 2B when it includes conventional drain wire(s).

The inventors of the present disclosure have discovered that the impedance changes in the cable 200 (e.g., the reduced impedance illustrated in FIG. 4, increases in impedance, etc.) that result from the repeated bending, flexing, or otherwise stressing of the conventional drain wire(s) can cause an impedance mismatch in the cable 200 that produces insertion losses that can result in signal attenuation of signals transmitted by the cable. For example, with reference to FIG. 5, an embodiment of an insertion loss graph 500 is illustrated that may be produced by the cable 200 discussed above with reference to FIGS. 2A, 2B, and 3A-3D over the life of the cable 200 when that cable 200 is repeatedly bent, flexed, and/or otherwise stressed. As will be appreciated by one of skill in the art in possession of the present disclosure, the insertion loss graph 500 illustrates the insertion losses produced by the cable 200 when a signal is transmitted using the cable components in that cable 200 such that a corresponding current returns via the conventional drain wires 206*a* and 206*b* provided on that cable 200, with the insertion losses measured following different numbers of bending cycles (e.g., bending the cable such that it cycles between the orientations of the cable 200 illustrated in FIGS. 3A and 3B). As can be seen in the specific example of the insertion loss graph 500 illustrated in FIG. 5, the insertion losses in the cable 200 reduced (from ~8.5 dB to ~5.5 dB) as the cable 200 experienced more bending cycles (from 0 to 500 bending cycles). However, one of skill in the art in possession of the present disclosure will appreciate that the insertion loss graph 500 illustrated in FIG. 5 is only an example, and that the cable 200 may experience different insertion losses (e.g., an increasing or decreasing rate of insertion loss) at different signal transmission frequencies as bending cycles are increased, with the varying, unpredictable insertion loss causing signal integrity issues over time.

The specific examples of the impedance graph 400 and the insertion graph 500 illustrate how impedance and insertion losses in a conventional cable will change as that cable (and in particular, its conventional drain wires) experience bending cycles, which identifies a signal integrity association with conventional drain wire bend cycling. Furthermore, such impedance and insertion loss changes may be particularly disruptive to relatively high-speed signals transmitted using conventional cables (e.g., as relatively low speed signals are not as dependent on impedance matching). Thus, conventional cables like the cable 200 when it utilizes conventional drain wires 206*a* and 206*b* provided by a solid conducting material (e.g., copper) and is repeatedly bent, flexed, and/or otherwise stressed may produce signal losses when relatively high-speed signals are transmitted using those cables.

Figure 6A:
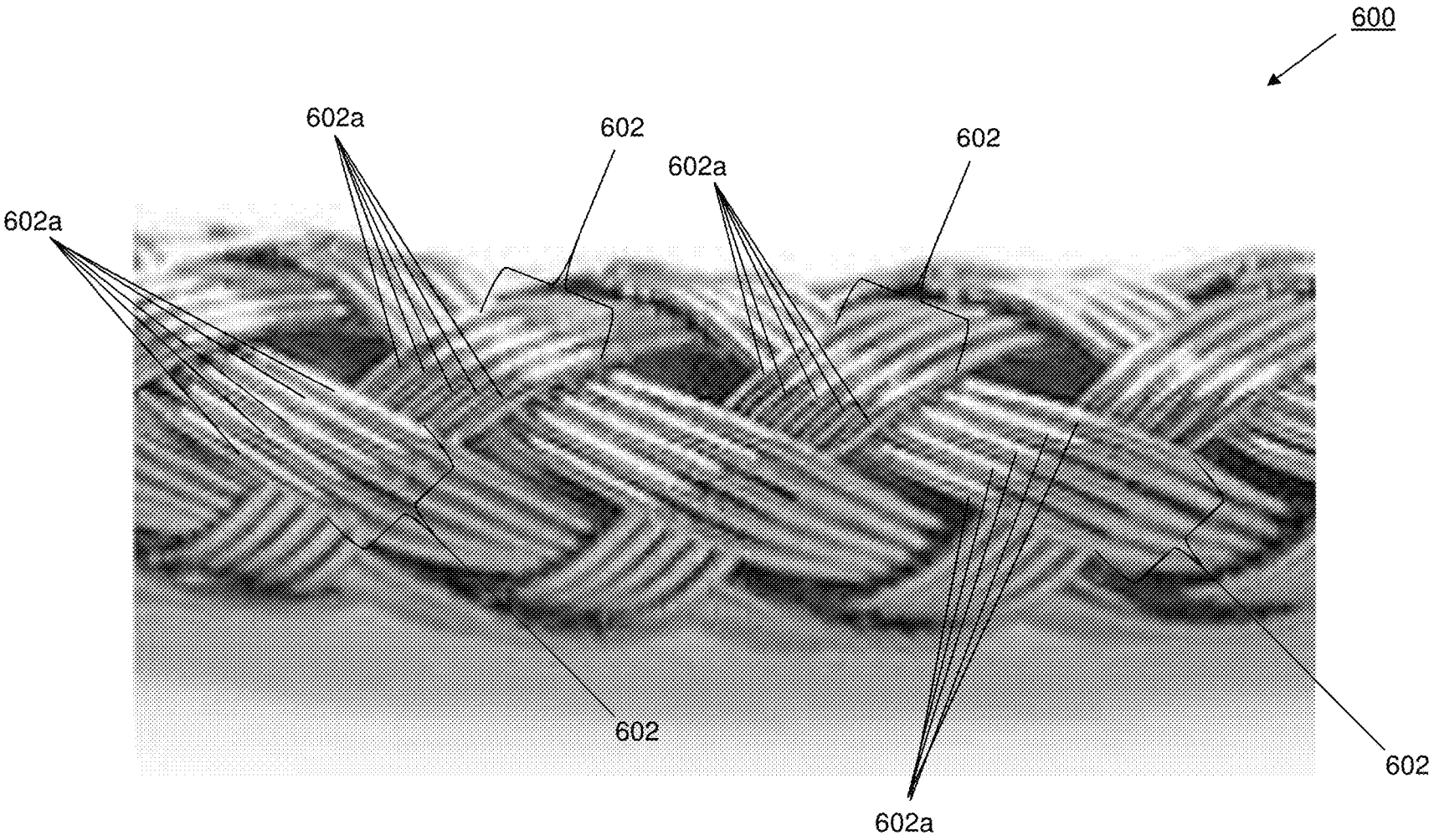
FIG. 6A is a perspective view illustrating an embodiment of a high-speed cable drain wire system provided according to the teachings of the present disclosure.
Figure 6B:
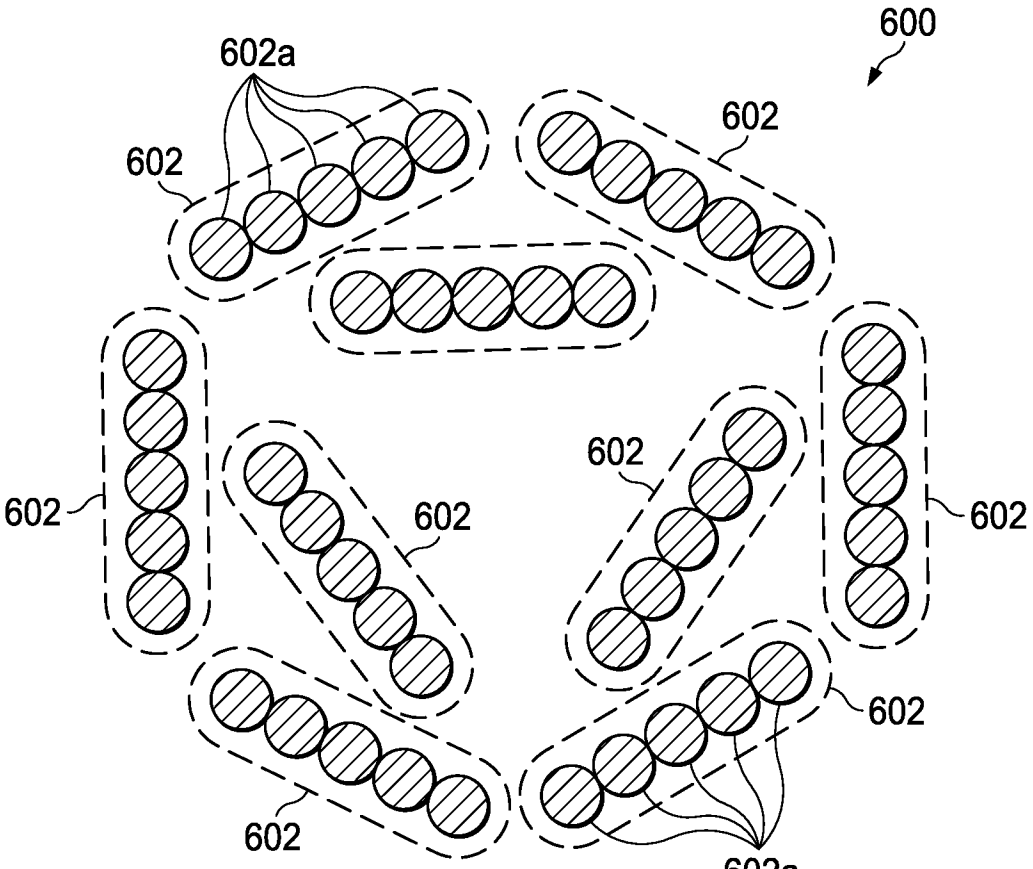
FIG. 6B is a cross-sectional view illustrating an embodiment of the high-speed cable drain wire system of FIG. 6A.

The high-speed cable drain wire system of the present disclosure replaces the conventional drain wire(s) provided by a solid conducting material (e.g., copper) with drain wire subsystem(s) that includes at least one drain wire strand, with each drain wire strand including a plurality of drain wires that one of skill in the art in possession of the present disclosure will appreciate are thinner (e.g., have a thinner radius) than conventional drain wires provided in conventional cables. For example, with reference to FIGS. 6A and 6B, an embodiment of a drain wire subsystem 600 is illustrated that includes a plurality of drain wire strands 602 (illustrated by dash lines in FIG. 6B), with each drain wire strand 602 including a plurality of drain wires 602*a*. In the specific example illustrated in FIGS. 6A and 6B, the drain wires 602*a* in each drain wire strand 602 in the drain wire subsystem 600 are provided in a side-by-side orientation, with the drain wire strands 602 in the drain wire subsystem 600 provided in braided orientation. However, while the drain wires 602*a* and drain wire strands 602 in the drain wire subsystem 600 are illustrated in particular orientations in FIGS. 6A and 6B, one of skill in the art in possession of the present disclosure will appreciate that the drain wires 602*a* may be provided in other orientations (e.g., the drain wires 602*a* in one or more drain wire strands 602 in the drain wire subsystem 600 may be provided in a braided orientation, a twisted orientation, and/or other orientations that would be apparent to one of skill in the art in possession of the present disclosure), and/or the drain wire strands 602 may be provided in other orientations (e.g., the drain wire strands 602 in the drain wire subsystem 600 may be provided in a twisted orientation and/or other orientations that would be apparent to one of skill in the art in possession of the present disclosure), while remaining within the scope of the present disclosure as well.

Figure 7A:
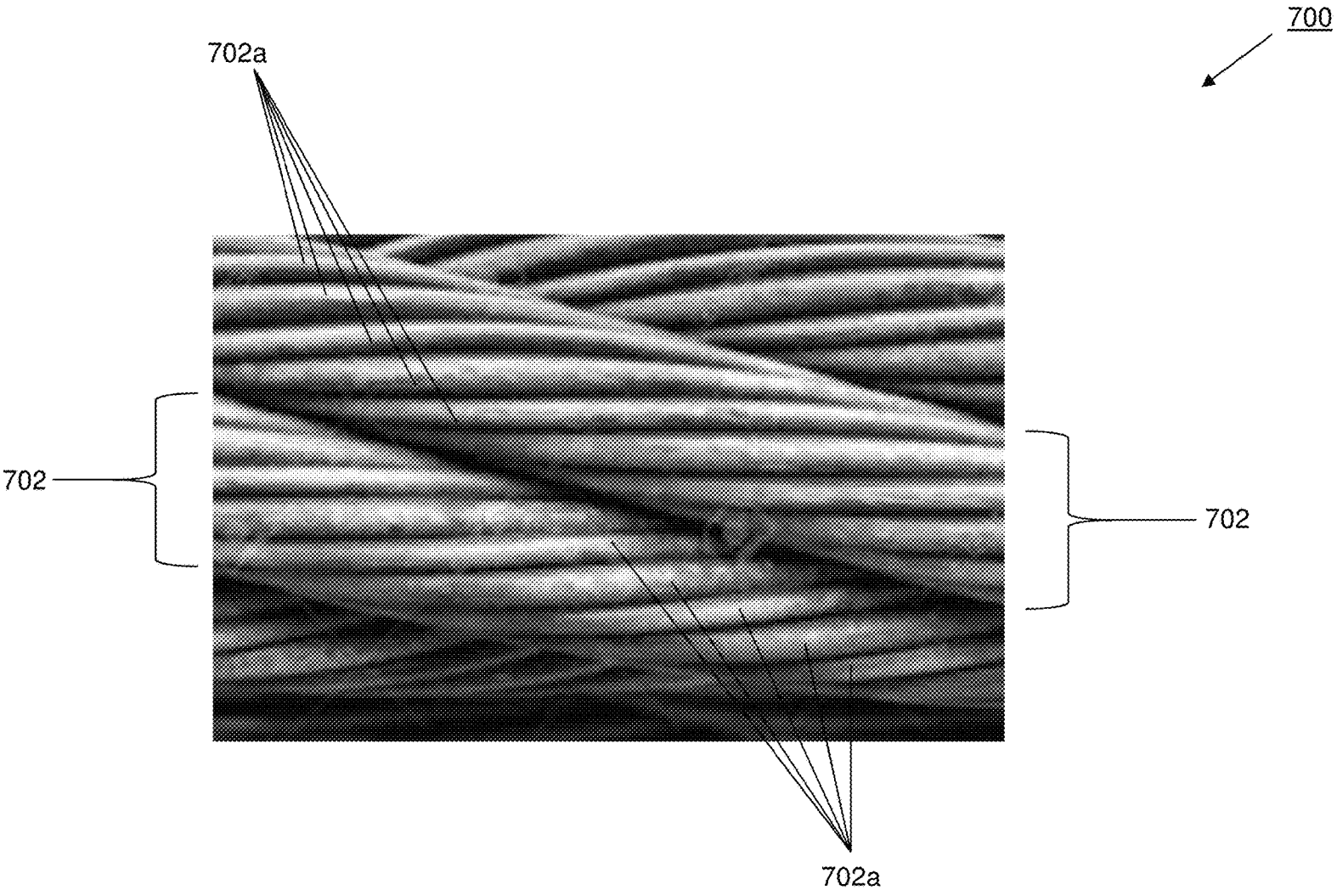
FIG. 7A is a perspective view illustrating an embodiment of a high-speed cable drain wire provided according to the teachings of the present disclosure.
Figure 7B:
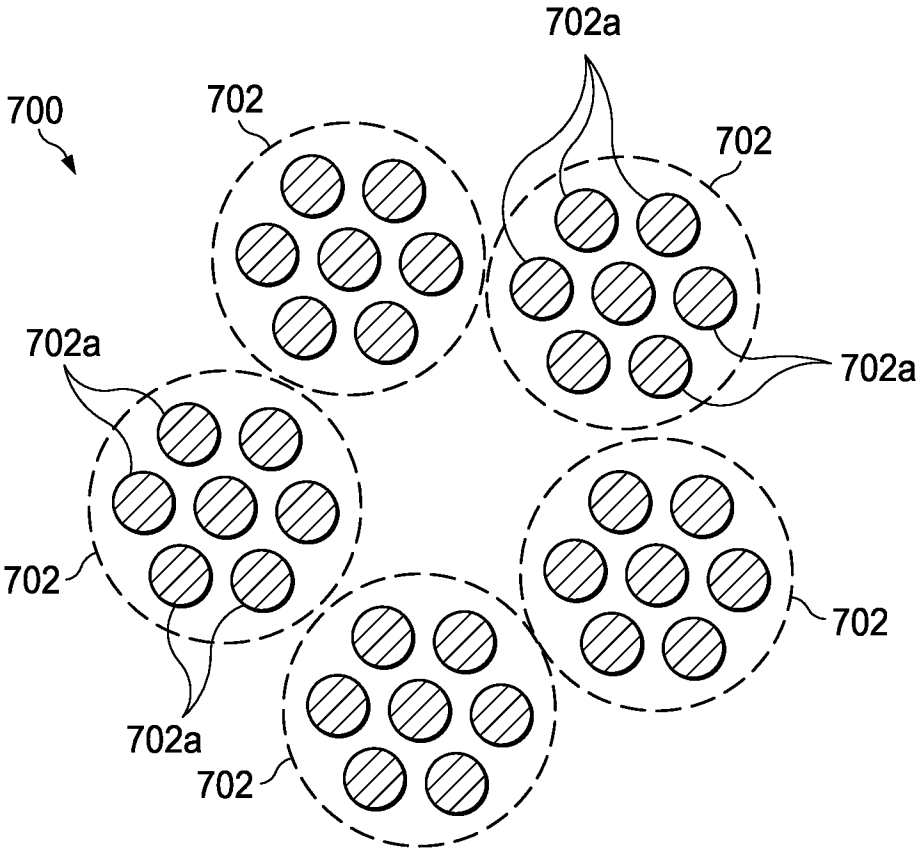
FIG. 7B is a cross-sectional view illustrating an embodiment of the high-speed cable drain wire system of FIG. 7A

In another example, with reference to FIGS. 7A and 7B, an embodiment of a drain wire subsystem 700 is illustrated that includes a plurality of drain wire strands 702 (illustrated by dash lines in FIG. 7B), with each drain wire strand 702 including a plurality of drain wires 702*a*. In the specific example illustrated in FIGS. 7A and 7B, the drain wires 702*a* in each drain wire strand 702 in the drain wire subsystem 700 are provided in a twisted orientation, with the drain wire strands 702 in the drain wire subsystem 700 provided in twisted orientation. However, while the drain wires 702*a* and drain wire strands 702 in the drain wire subsystem 700 are illustrated in particular orientations in FIGS. 7A and 7B, one of skill in the art in possession of the present disclosure will appreciate that the drain wires 702*a* may be provided in other orientations (e.g., the drain wires 702*a* in one or more drain wire strands 702 in the drain wire subsystem 700 may be provided in a braided orientation, a side-by-side orientation, and/or other orientations that would be apparent to one of skill in the art in possession of the present disclosure), and/or the drain wire strands 702 may be provided in other orientations (e.g., the drain wire strands 702 in the drain wire subsystem 700 may be provided in a braided orientation and/or other orientations that would be apparent to one of skill in the art in possession of the present disclosure), while remaining within the scope of the present disclosure as well.

Figure 8A:
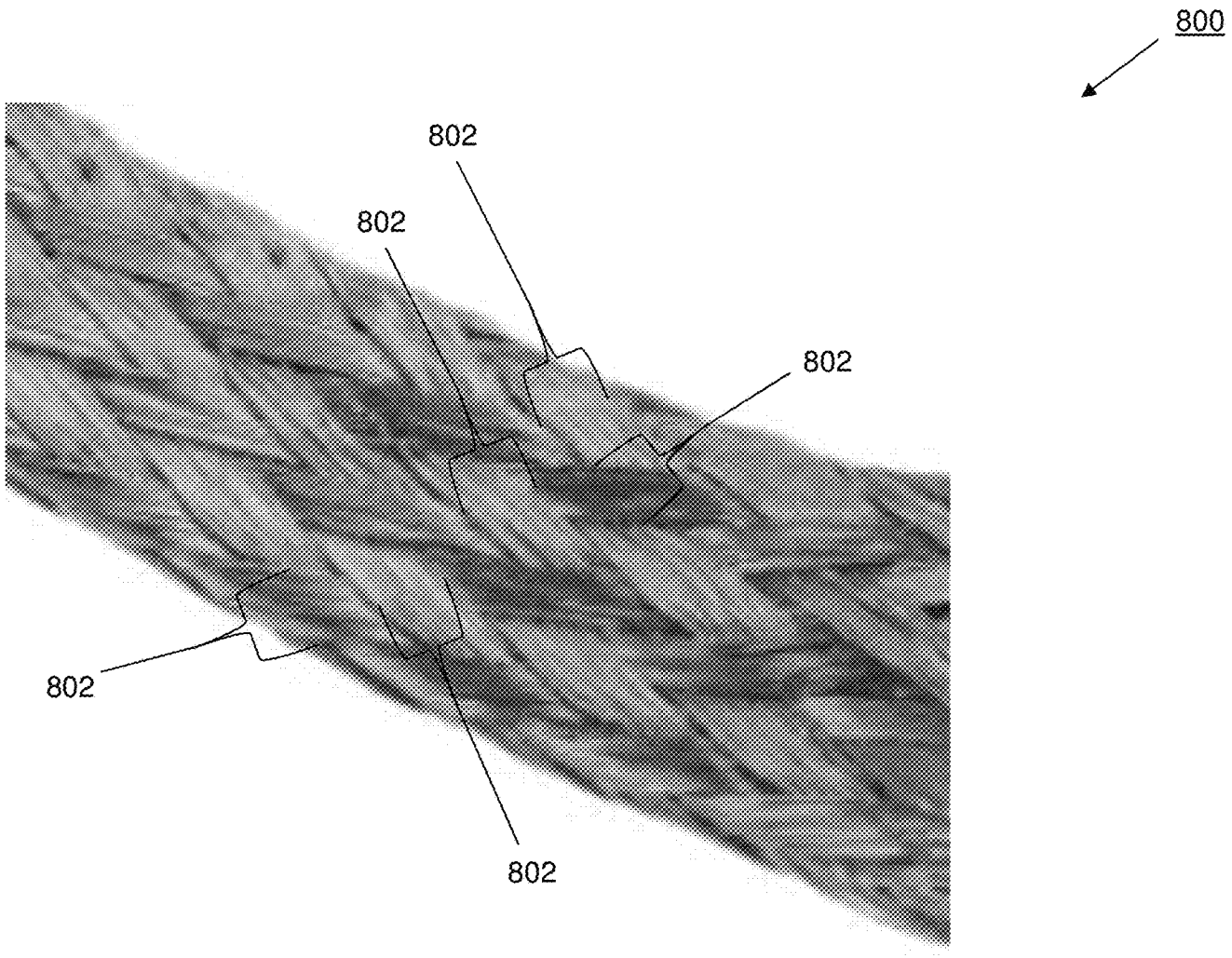
FIG. 8A is a perspective view illustrating an embodiment of a high-speed cable drain wire system provided according to the teachings of the present disclosure.
Figure 8B:
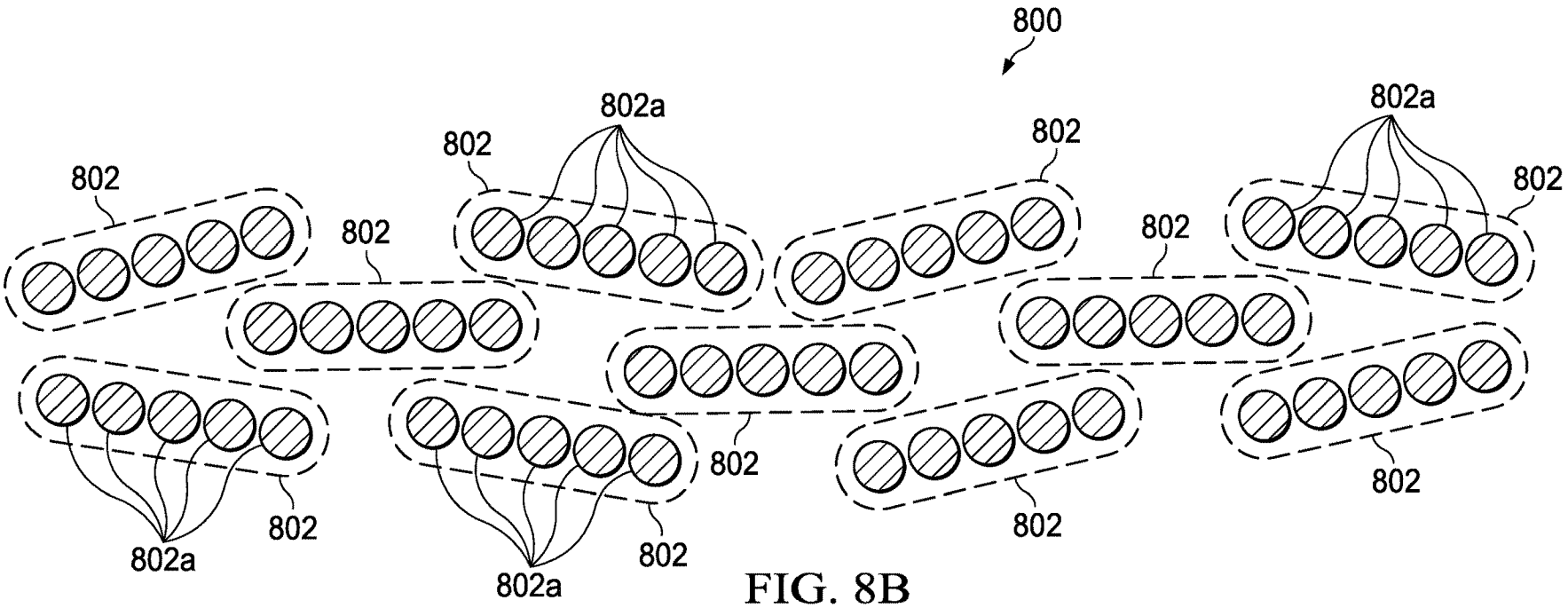
FIG. 8B is a cross-sectional view illustrating an embodiment of the high-speed cable drain wire system of FIG. 8A

In another example, with reference to FIGS. 8A and 8B, an embodiment of a drain wire subsystem 800 is illustrated that includes a plurality of drain wire strands 802 (illustrated by dash lines in FIG. 8B), with each drain wire strand 802 including a plurality of drain wires 802*a*. In the specific example illustrated in FIGS. 8A and 8B, the drain wires 802*a* in each drain wire strand 802 in the drain wire subsystem 800 are provided in a side-by-side orientation, with the drain wire strands 802 in the drain wire subsystem 800 provided in braided orientation. However, while the drain wires 802*a* and drain wire strands 802 in the drain wire subsystem 800 are illustrated in particular orientations in FIGS. 8A and 8B, one of skill in the art in possession of the present disclosure will appreciate that the drain wires 802*a* may be provided in other orientations (e.g., the drain wires 802*a* in one or more drain wire strands 802 in the drain wire subsystem 800 may be provided in a braided orientation, a twisted orientation, and/or other orientations that would be apparent to one of skill in the art in possession of the present disclosure), and/or the drain wire strands 802 may be provided in other orientations (e.g., the drain wire strands 802 in the drain wire subsystem 800 may be provided in a twisted orientation and/or other orientations that would be apparent to one of skill in the art in possession of the present disclosure), while remaining within the scope of the present disclosure as well.

While several specific drain wire subsystems are illustrated, one of skill in the art in possession of the present disclosure will appreciate that the drain wire subsystems may be configured different while remaining within the scope of the present disclosure as well. For example, some embodiments may provide a drain wire subsystem with a single drain write strand having a plurality of drain wires in a braided orientation, a twisted orientation, a side-by-side-orientation, and/or other orientations that would be apparent to one of skill in the art in possession of the present disclosure while remaining within the scope of the present disclosure as well. Furthermore, while the drain wire subsystems are illustrated and described herein as being provided in a single cable, one of skill in the art in possession of the present disclosure will appreciate that multiple cables having the drain wire subsystems described herein may be provided together in a flat/ribbon cable and/or other multi-cable systems while remaining within the scope of the present disclosure as well.

As will be appreciated by one of skill in the art in possession of the present disclosure with reference to the bending stress equation above, the drain wire subsystems of the present disclosure reduce the stresses experienced by the drain wires included in each of their drain wire strands (e.g., relative to conventional drain wires provided in conventional cables), as those drain wires have a smaller radius than conventional drain wires provided in conventional cables, and thus have a relatively smaller "y" variable in the bending stress equation. As such, the compressive and tensile stresses experienced by any drain wire in a drain wire strand in a drain wire subsystem will be less than those experienced by conventional drain wires provided in conventional cables. Furthermore, the orientation of the drain wires in each drain wire strand in the drain wire subsystem, as well as the orientation of the drain wire strands in the drain wire subsystem, allows the drain wires to move relatively to each other during bending, flexing, and/or other stressing, which has been found to further reduce mechanical stresses experienced by those drain wires.

However, while specific examples of drain wire subsystems having a plurality of drain wire strands that each include a plurality of drain wires have been illustrated and described as overcoming the mechanical stress issues associated with conventional drain wires, the inventors of the present disclosure have developed other drain wire subsystems for overcoming the mechanical stress issues associated with conventional drain wires as well. For example, the inventors of the present disclosure have discovered that a coating layer may be provided on a drain wire in order to mechanically limit the bending radius of that drain wire and thus reduce the stresses experienced by the drain wire during bending, flexing, and/or other stressing (e.g., by increasing the p variable in the bending stress equation provided above). In some embodiments, the coating layer discussed above may be conductive. In other embodiments, the coating layer discussed above may be non-conductive, which may operate to change the cable shield/cable component configuration provided in the cable (e.g., the drain wire including the non-conductive coating layer may be provided some direct contact between the drain wire and the cable shield at some location along their length (e.g., at the cable termination)).

Figure 9:
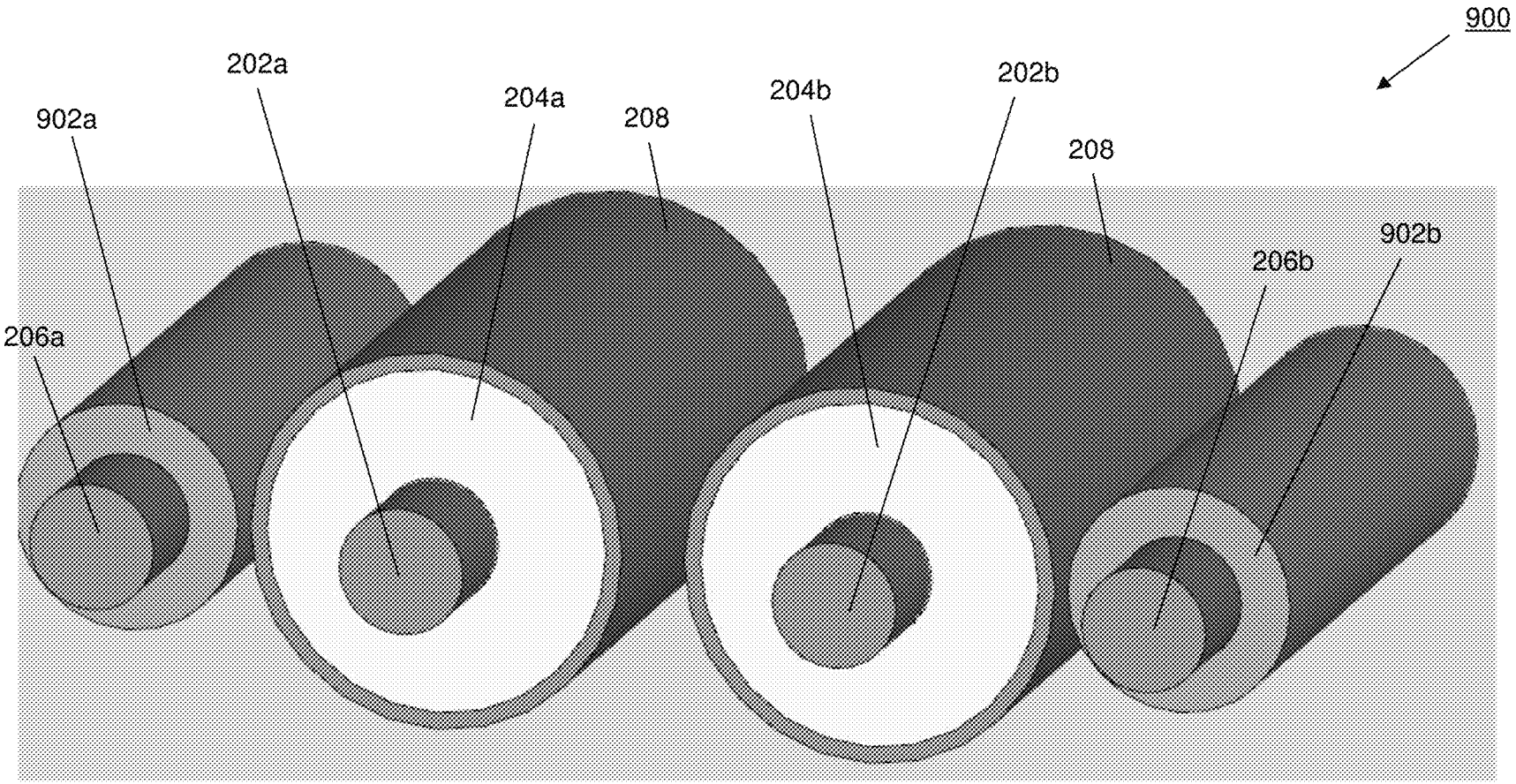
FIG. 9 is a perspective, cross-sectional view illustrating an embodiment of a cable including another high-speed cable drain wire system provided according to the teachings of the present disclosure.

For example, FIG. 9 illustrates a cable 900 including the conductors 202*a* and 202*b*, the insulators 204*a* and 204*b*, and the drain wires 206*a* and 206*b* discussed above with reference to FIGS. 2A and 2B. As will be appreciated be one of skill in the art in possession of the present disclosure, each of the drain wires 206*a* and 206*b* in the cable 900 may be provided by a solid conducting material (e.g., copper) like conventional drain wires, but may each be part of a drain wire subsystem that includes a coating layer (e.g., the coating layer 902*a* provided on the conductor 206*a* in FIG. 9, and the coating layer 902*b* provided on the conductor 206*b* in FIG. 9). However, while the drain wires 206*a* and 206*b* are discussed as being provided by a solid conducting material (e.g., copper) like conventional drain wires, one of skill in the art in possession of the present disclosure will appreciate that the drain wires 206*a* and 206*b* may instead be provided by the drain wire subsystems of the present disclosure, with those drain wire subsystems provided with the coating layers 902*a* and 902*b*, respectively, while remaining within the scope of the present disclosure as well. In the embodiment illustrated in FIG. 9, the cable 900 provides a respective cable shield 208 around each insulator 204*a* and 204*b* on each conductor 202*a* and 202*b*, with the drain wires 206*a*/206*b* and coating layers 1002*a*/1002*b* located outside those cable shields 208.

Figure 10:
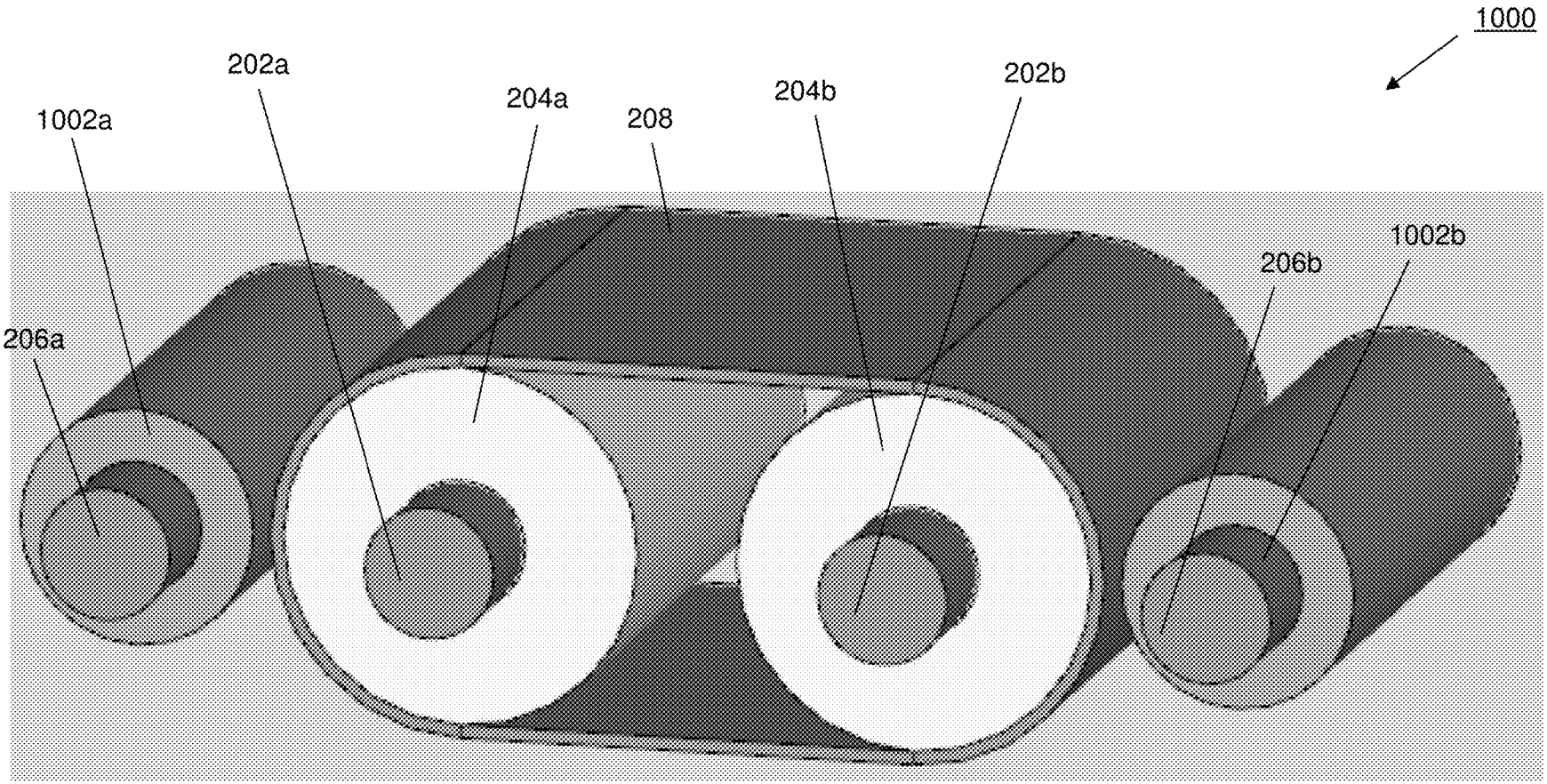
FIG. 10 is a perspective, cross-sectional view illustrating an embodiment of a cable including another high-speed cable drain wire system provided according to the teachings of the present disclosure.

In another example, FIG. 10 illustrates a cable 1000 including the conductors 202*a* and 202*b*, the insulators 204*a* and 204*b*, and the drain wires 206*a* and 206*b* discussed above with reference to FIGS. 2A and 2B. As will be appreciated be one of skill in the art in possession of the present disclosure, each of the drain wires 206*a* and 206*b* in the cable 1000 may be provided by a solid conducting material (e.g., copper) like conventional drain wires, but may each be part of a drain wire subsystem that includes a coating layer (e.g., the coating layer 1002*a* provided on the conductor 206*a* in FIG. 10, and the coating layer 1002*b* provided on the conductor 206*b* in FIG. 10). However, while the drain wires 206*a* and 206*b* are discussed as being provided by a solid conducting material (e.g., copper) like conventional drain wires, one of skill in the art in possession of the present disclosure will appreciate that the drain wires 206*a* and 206*b* may instead be provided by the drain wire subsystems of the present disclosure, with those drain wire subsystems provided with the coating layers 1002*a* and 1002*b*, respectively, while remaining within the scope of the present disclosure as well. In the embodiment illustrated in FIG. 10, the cable 1000 provides a cable shield 208 around both insulators 204*a* and 204*b* on the conductors 202*a* and 202*b*, with the drain wires 206*a*/206*b* and coating layers 1002*a*/1002*b* located outside those cable shield 208.

Figure 11:
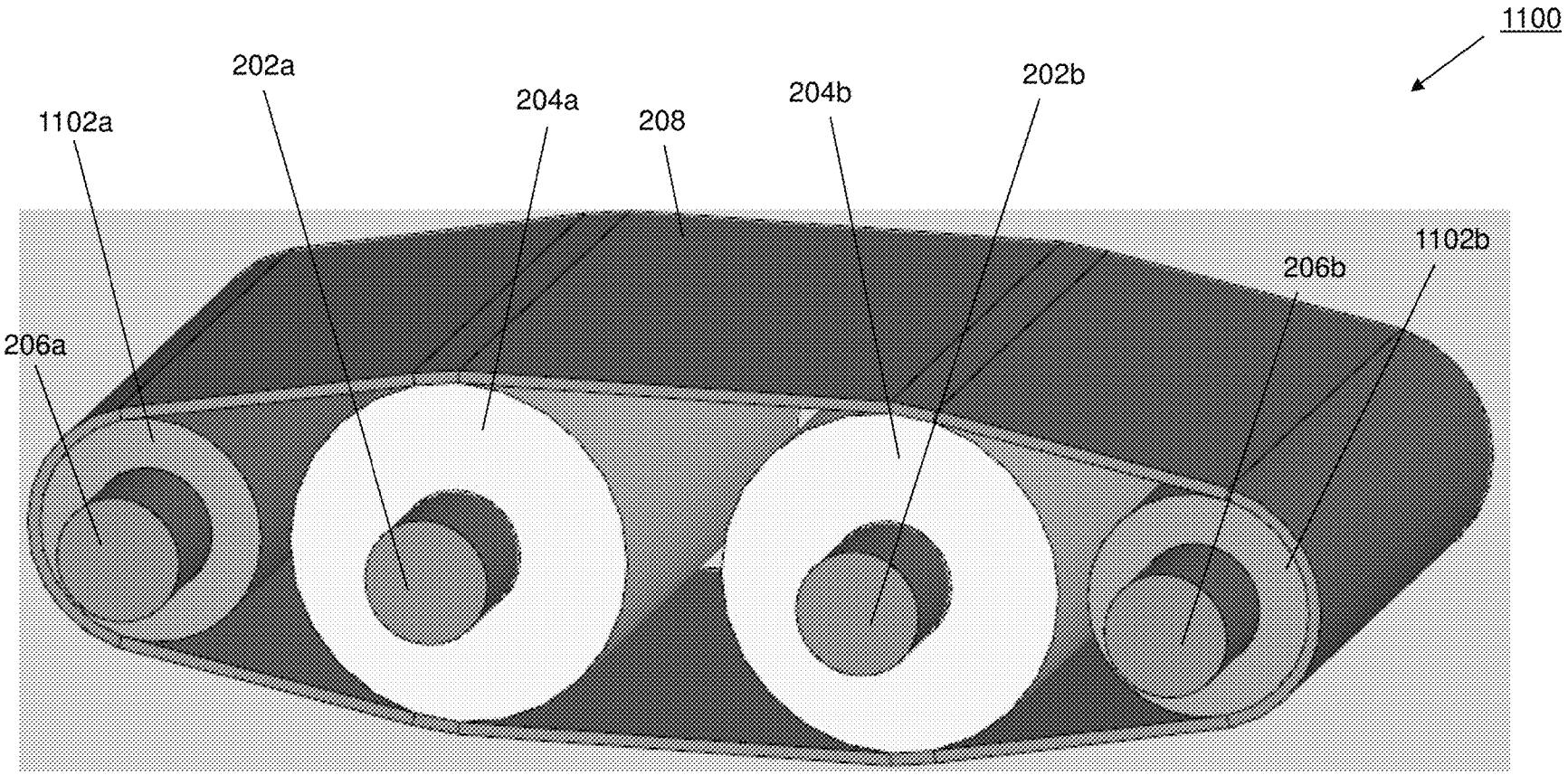
FIG. 11 is a perspective, cross-sectional view illustrating an embodiment of a cable including another high-speed cable drain wire system provided according to the teachings of the present disclosure.

In another example, FIG. 11 illustrates a cable 1100 including the conductors 202*a* and 202*b*, the insulators 204*a* and 204*b*, and the drain wires 206*a* and 206*b* discussed above with reference to FIGS. 2A and 2B. As will be appreciated be one of skill in the art in possession of the present disclosure, each of the drain wires 206*a* and 206*b* in the cable 1100 may be provided by a solid conducting material (e.g., copper) like conventional drain wires, but may each be part of a drain wire subsystem that includes a coating layer (e.g., the coating layer 1102*a* provided on the conductor 206*a* in FIG. 11, and the coating layer 1102*b* provided on the conductor 206*b* in FIG. 11). However, while the drain wires 206*a* and 206*b* are discussed as being provided by a solid conducting material (e.g., copper) like conventional drain wires, one of skill in the art in possession of the present disclosure will appreciate that the drain wires 206*a* and 206*b* may instead be provided by the drain wire subsystems of the present disclosure, with those drain wire subsystems provided with the coating layers 1102*a* and 1102*b*, respectively, while remaining within the scope of the present disclosure as well. In the embodiment illustrated in FIG. 11, the cable 1100 provides a cable shield 208 around both insulators 204*a* and 204*b* on the conductors 202*a* and 202*b*, as well as around the drain wires 206*a*/206*b* and coating layers 1002*a*/1002*b*.

Figure 12:
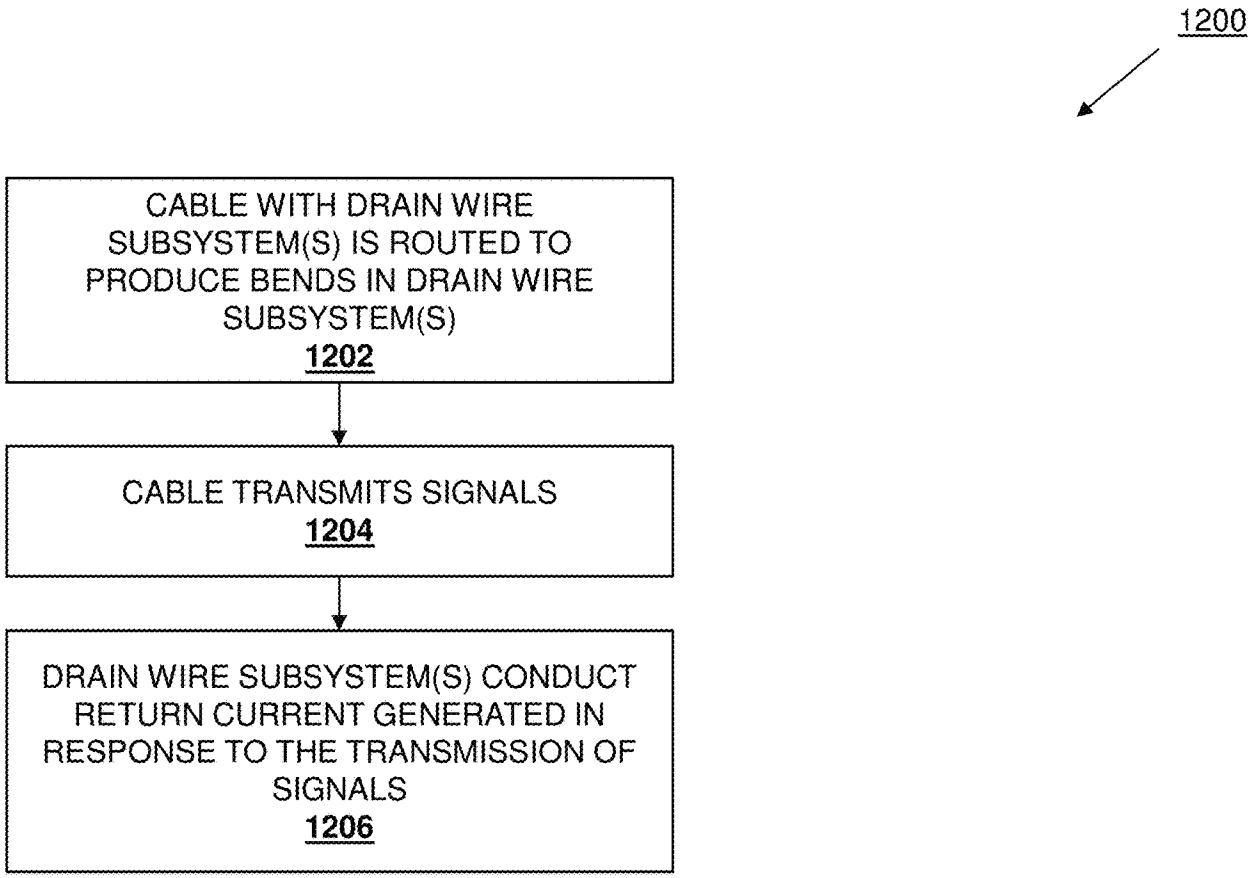
FIG. 12 is a flow chart illustrating an embodiment of a method for transmitting a signal using a cable having high-speed cable drain wire system(s) provided according to the teachings of the present disclosure.

Referring now to FIG. 12, an embodiment of a method 1200 for transmitting a signal using a cable having drain wire subsystems is illustrated. As discussed below, the systems and methods of the present disclosure provide cables with drain wire subsystems that are made up of a plurality of drain wires that, when the cable is bent, experience reduced stresses as compared to conventional drain wires. For example, the high-speed cable drain wire system of the present disclosure may include a cable shield housing conductor(s), an insulator subsystem that surrounds the conductor(s), and drain wire subsystem(s) that each have at least one drain wire strand, with each drain wire strand including a plurality of drain wires. The plurality of drain wires in each drain wire strand may be positioned in a side-by-side orientation or a twisted orientation, and the plurality of drain wire strands in each drain wire subsystem may be positioned in a braided orientation or a twisted orientation. In response to routing the cable, a bend may be produced in the drain wire subsystem(s), and the plurality of drain wires in each drain wire strand are configured to experience a stress that is less than a stress threshold in response to the bend. Thus, the drain wire subsystems of the present disclosure enable the cables in which they are provided to be repeatedly bent, flexed, and/or otherwise stressed without producing the signal attenuation issues that are associated with conventional drain wires that undergo similar bending, flexing, and/or otherwise stressing.

The method 1200 begins at block 1202 where a cable with drain wire subsystem(s) is routed to produce bends in the drain wire subsystem(s). In an embodiment, at block 1202, the cable 200 with any of the drain wire subsystems 600, 700, or 800 may be connected to connectors in one or more computing devices that each may be provided by, for example, the IHS 100 discussed above with reference to FIG. 1. In an embodiment, each computing device may include a processing system, and a memory system that is coupled to the processing system and that includes instructions that, when executed by the processing system, cause the processing system to provide a signal transmission engine that is configured to transmit signals. As part of the connecting the cable 200 to the connectors in the one or more computing devices, the cable 200 may be routed between those connectors, which may include bending, flexing, and/or otherwise stressing the cable 200 in order to configure that cable 200 along a route between those connectors. Furthermore, one of skill in the art in possession of the present disclosure will appreciate that repeated routing or re-routing of the cable 200 may provide for the repetitive bending, flexing, and/or otherwise stressing the cable 200, as will the movement of the cable 200 (e.g., due to movement of the computing device(s) to which it is connected).

However, as discussed above, the plurality of drain wires in each drain wire strand in the drain wire subsystem(s) 600/700/800 are configured to experience a stress that is less than a stress threshold in response to the bending, flexing, other otherwise stressing of the cable 200 during the routing of block 1202 due to, for example, the relative thinness of those drain wires (e.g., as compared to conventional drain wires in conventional cables.) As such, depending on the potential uses of the cable 200 (e.g., the possible routing configurations of that cable) 200), the configuration of the drain wire subsystems in the cable 200 may be selected to ensure that mechanical stresses do not lead to mechanical degradation that could cause signal attenuation to occur.

The method 1200 then proceeds to block 1204 where the cable transmits the signals. In an embodiment, at block 1204, the computing device may generate signals and provide those signals to a connector on the computing device to which the cable 200 is connected such that one or more of the cable components in the cable 200 (e.g., the conductors 202*a* and 202*b*) receive those signals. In an embodiment, the signals may be received by the cable 200 at block 1204 at a signal transmission speed of at least 1 GHz. Furthermore, in an embodiment of block 1204 and in response to receiving the signals from the computing device, the cable components in the cable 200 (e.g., the conductors 202*a* and 202*b*) may operate to transmit those signals along the length of the cable 200. As discussed above, the transmission of signals via the cable 200 will result in a corresponding current returning via the drain wire subsystem(s) 600/700/800.

The method 1200 then proceeds to block 1206 where the drain wire subsystem(s) in the cable conduct the return current generated in response to the transmission of the signal via the cable. In an embodiment, at block 1206, the return current in the drain wire subsystems 600/700/800 in the cable 200 (in response to the transmission of signals via the cable components in the cable 200) will flow through the drain wires in the drain wire strands of the drain wire subsystem(s) 600/700/800. As discussed above, the plurality of drain wires in each drain wire strand in the drain wire subsystem(s) 600/700/800 are configured to experience a stress that is less than a stress threshold in response to the bending, flexing, other otherwise stressing of the cable 200 during the routing of block 1202, thus preventing the mechanical degradation that occurs in conventional drain wires, and ensuring that the conduction of the return current at block 1206 will not produce an impedance that results in insertion losses in the cable 200 (as occurs in conventional cables discussed above with reference to FIGS. 4 and 5).

Thus, systems and methods have been described that provide cables with drain wire subsystems that are made up of a plurality of drain wires that, when the cable is bent, experience reduced stresses as compared to conventional drain wires. For example, the high-speed cable drain wire system of the present disclosure may include a cable shield housing conductor(s), an insulator subsystem that surrounds the conductor(s), and drain wire subsystem(s) that each have a plurality of drain wire strands that each include a plurality of drain wires. The plurality of drain wires in each drain wire strand may be positioned in a side-by-side orientation or a twisted orientation, and the plurality of drain wire strands in each drain wire subsystem may be positioned in a braided orientation or a twisted orientation. In response to routing the cable, a bend may be produced in the drain wire subsystem(s), and the plurality of drain wires in each drain wire strand are configured to experience a stress that is less than a stress threshold in response to the bend. Thus, the drain wire subsystems of the present disclosure enable the cables in which they are provided to be repeatedly bent, flexed, and/or otherwise stressed without producing the signal attenuation issues that are associated with conventional drain wires that undergo similar bending, flexing, and/or otherwise stressing.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A high-speed cable drain wire system, comprising:

a cable shield;

a first conductor that is housed in the cable shield;

an insulator subsystem that surrounds the first conductor and that is housed in the cable shield; and a first drain wire subsystem that is housed in the cable shield and that includes a plurality of first drain wire strands that are provided in a first type of orientation, wherein each first drain wire strand includes a plurality of first drain wires that are provided in a second type of orientation.

2. The system of claim 1, further comprising:

a second conductor that is housed in the cable shield, wherein the insulator subsystem surrounds the second conductor; and a second drain wire subsystem that is housed in the cable shield and that includes at least one second drain wire strand, wherein each second drain wire strand includes a plurality of second drain wires.

3. The system of claim 1, wherein the second type of orientation is a side-by-side orientation.

4. The system of claim 1, wherein the second type of orientation is a twisted orientation.

5. The system of claim 1, wherein the first type of orientation is a braided orientation.

6. The system of claim 1, wherein the first type of orientation is a twisted orientation.

7. An Information Handling System (IHS), comprising:

a processing system;

a memory system that is coupled to the processing system and that includes instructions that, when executed by the processing system, cause the processing system to provide a signal transmission engine; and a cable that is coupled to the processing system, wherein the cable includes:

a cable shield;

a first conductor that is housed in the cable shield and that is configured to transmit signals received from the signal transmission engine;

an insulator subsystem that surrounds the first conductor and that is housed in the cable shield; and a first drain wire subsystem that is housed in the cable shield and that is configured to conduct a first return current that is generated in response to the first conductor transmitting the signals, wherein the first drain wire subsystem includes a plurality of first drain wire strands that are provided in a first type of orientation, wherein each first drain wire strand includes a plurality of first drain wires that are provided in a second type of orientation.

8. The IHS of claim 7, wherein the cable includes:

a second conductor that is housed in the cable shield and that is configured to transmit the signals received from the signal transmission engine, wherein the insulator subsystem surrounds the second conductor; and a second drain wire subsystem that is housed in the cable shield and that is configured to conduct a second return current that is generated in response to the second conductor transmitting the signals, wherein the second drain wire subsystem includes at least one second drain wire strand, and wherein each second drain wire strand includes a plurality of second drain wires.

9. The IHS of claim 7, wherein the second type of orientation is a side-by-side orientation.

10. The IHS of claim 7, wherein the second type of orientation is a twisted orientation.

11. The IHS of claim 7, wherein the first type of orientation is a braided orientation.

12. The IHS of claim 7, wherein the first type of orientation is a twisted orientation.

13. The IHS of claim 7, wherein the plurality of first drain wires are configured to move relative to each other when the first drain wire subsystem is bent.

14. A method for, comprising:

routing a cable that includes a cable shield that houses:

a first conductor surrounded by an insulator subsystem; and a first drain wire subsystem including a plurality of first drain wire strands that are provided in a first type of orientation, wherein each first drain wire strand includes a plurality of first drain wires that are provided in a second type of orientation;

bending, in response to routing the cable, the cable to produce a bend in the first drain wire subsystem, wherein the plurality of first drain wires in each first drain wire strand are configured to experience a stress that is less than a stress threshold in response to the bend;

transmitting, via the first conductor, signals; and conducting, via the first drain wire subsystem, a first return current that is generated in response to transmitting the signals.

15. The method of claim 14, wherein the cable shield houses:

a second conductor surrounded by the insulator subsystem; and a second drain wire subsystem including at least one second drain wire strand, wherein each second drain wire strand includes a plurality of second drain wires, and wherein the method further comprises:

bending, in response to routing the cable, the cable to produce a bend in the second drain wire subsystem, wherein the plurality of second drain wires in each second drain wire strand are configured to experience a stress that is less than a stress threshold in response to the bend;

transmitting, via the second conductor, signals; and conducting, via the second drain wire subsystem, a second return current that is generated in response to transmitting the signals.

16. The method of claim 14, wherein the second type of orientation is a side-by-side orientation.

17. The method of claim 14, wherein the second type of orientation is a twisted orientation.

18. The method of claim 14, wherein first type of orientation is a braided orientation.

19. The method of claim 14, wherein the first type of orientation is a twisted orientation.

20. The method of claim 14, further comprising:

moving, by the plurality of first drain wires in response to the bending of the drain wire subsystem, relative to each other.

* * * * *